US010538890B2

(12) United States Patent
Ma et al.

(10) Patent No.: US 10,538,890 B2
(45) Date of Patent: Jan. 21, 2020

(54) HYDRAULIC SHIP LIFT WITH ANTI-OVERTURNING CAPABILITY AND METHOD FOR USING THE SAME

(71) Applicants: HUANENG LANCANG RIVER HYDROPOWER INC., Kunming (CN); POWER CHINA KUNMING ENGINEERING CORPORATION LIMITED, Kunming (CN); NANJING HYDRAULIC RESEARCH INSTITUTE, Nanjing (CN); CHINA INSTITUTE OF WATER RESOURCES AND HYDROPOWER RESEARCH, Beijing (CN)

(72) Inventors: Hongqi Ma, Kunming (CN); Yaan Hu, Nanjing (CN); Zongliang Zhang, Kunming (CN); Xianghua Yuan, Kunming (CN); Zejiang Xiang, Kunming (CN); Yongping Al, Kunming (CN); Yimin Chuan, Kunming (CN); Guanqun Nan, Kunming (CN); Rui Zou, Kunming (CN); Zhaoxin Chen, Kunming (CN); Xiaolin Hu, Kunming (CN); Hongtao Zhang, Kunming (CN); Haibin Xiao, Kunming (CN); Qun Huang, Kunming (CN); Keheng Zhou, Kunming (CN); Xuexing Cao, Kunming (CN); Zichong Li, Kunming (CN); Renchao Ma, Kunming (CN); Yinan Cao, Kunming (CN); Yun Ling, Kunming (CN); Sisi Xie, Kunming (CN); Junyang Yu, Kunming (CN); Zhonghua Li, Nanjing (CN); Yun Li, Nanjing (CN); Guoxiang Xuan, Nanjing (CN); Xin Wang, Nanjing (CN); Xiujun Yan, Nanjing (CN); Shu Xue, Nanjing (CN); Chao Guo, Nanjing (CN); Yue Huang, Nanjing (CN); Yihong Wu, Beijing (CN); Rui Zhang, Beijing (CN); Dong Zhang, Beijing (CN); Jinxiong Zhang, Beijing (CN); Wenyuan Zhang, Beijing (CN); Hongwei Zhang, Beijing (CN); Jianbiao Gao, Beijing (CN)

(73) Assignees: HUANENG LANCANG RIVER HYDROPOWER INC., Kunming (CN); POWER CHINA KUNMING ENGINEERING CORPORATION LIMITED, Kunming (CN); NANJING HYDRAULIC RESEARCH INSTITUTE, Nanjing (CN); CHINA INSTITUTE OF WATER RESOURCES AND HYDROPOWER RESEARCH, Beijing (CN)

( * ) Notice: Subject to any disclaimer, the term of this patent is extended or adjusted under 35 U.S.C. 154(b) by 0 days.

(21) Appl. No.: 15/853,687

(22) Filed: Dec. 22, 2017

(65) Prior Publication Data

US 2018/0119379 A1 May 3, 2018

Related U.S. Application Data

(63) Continuation-in-part of application No. PCT/CN2016/090815, filed on Jul. 21, 2016.

(30) Foreign Application Priority Data

Jan. 16, 2016 (CN) ..... 2016 1 0027194

(51) Int. Cl.
*B63C 3/06* (2006.01)
*B63C 3/12* (2006.01)
*E02C 5/00* (2006.01)

(52) U.S. Cl.
CPC ..... *E02C 5/00* (2013.01)

(58) Field of Classification Search
CPC ..... E02C 5/00; B66C 13/02; B66C 23/52; B66C 23/90; B66C 13/04; B63C 3/06; B63B 27/10; B63B 23/40; B63B 23/60
See application file for complete search history.

(56) References Cited

U.S. PATENT DOCUMENTS 62,736 A * 3/1867 Day ..... E02C 5/00 405/86
153,156 A * 7/1874 Clark ..... E02C 5/00 405/86

(Continued)

*Primary Examiner* — Benjamin F Fiorello
*Assistant Examiner* — Edwin J Toledo-Duran
(74) *Attorney, Agent, or Firm* — Matthias Scholl P.C.; Matthias Scholl

(57) ABSTRACT

A hydraulic ship lift, including: a mechanical synchronizing system; a stabilizing and equalizing hydraulic driving system; and a self-feedback stabilizing system. The stabilizing and equalizing hydraulic driving system includes first resistance equalizing members arranged at corners of branch water pipes or/and second resistance equalizing members arranged at bifurcated pipes, circular forced ventilating mechanisms arranged at front of water delivery valves of a water delivery main pipe, and pressure-stabilizing and vibration-reducing boxes arranged behind the water delivery valves. The self-feedback stabilizing system includes a plurality of guide wheels; each guide wheel of the self-feedback stabilizing system is fixed on a ship reception chamber through a supporting mechanism. The supporting mechanism includes a base connected to the ship reception chamber, a support articulated on the base, a flexible member fixedly arranged between the support and the base, and a limiting stopper arranged on the outer side of the flexible member.

10 Claims, 23 Drawing Sheets

(56) References Cited

U.S. PATENT DOCUMENTS 416,613 A * 12/1889 Hoffmann ..... E02C 5/00 405/86
513,800 A * 1/1894 Lubowski ..... E02C 5/00 405/86
557,564 A * 4/1896 Dutton ..... E02C 5/00 405/86
557,566 A * 4/1896 Dutton ..... E02C 5/00 405/86
561,902 A * 6/1896 Lubowski ..... E02C 5/00 405/86
619,043 A * 2/1899 Hoech ..... E02C 5/00 405/86
665,414 A * 1/1901 Dutton ..... E02C 5/00 405/86
758,857 A * 5/1904 Saner ..... E02C 5/00 405/86
1,336,075 A * 4/1920 Eglit ..... B63B 23/08 114/373
1,336,394 A * 4/1920 Super ..... B63B 23/06 114/373
1,629,419 A * 5/1927 Sorensen ..... B63B 23/10 114/373
2,151,394 A * 3/1939 Rogers ..... E02C 5/00 405/3
2,505,832 A * 5/1950 Lange ..... B63C 3/06 405/3
2,585,664 A * 2/1952 Le May ..... B63C 3/06 254/91
3,012,757 A * 12/1961 Marzolf ..... B63C 3/06 254/280
3,045,839 A * 7/1962 Hibberd ..... B63B 9/00 414/678
3,073,125 A * 1/1963 Pearlson ..... B63B 9/00 405/3
3,145,854 A * 8/1964 Sturm ..... B63B 27/00 14/71.1
3,150,389 A * 9/1964 Woodworth ..... E02C 5/00 114/374
3,177,668 A * 4/1965 Schneider ..... B63C 3/06 405/3
3,252,589 A * 5/1966 Keene ..... B63C 3/06 414/560
3,284,052 A * 11/1966 Godbersen ..... B63B 9/00 405/3
3,398,540 A * 8/1968 Toben ..... E02C 5/00 405/86
3,402,828 A * 9/1968 Vilter ..... B63C 3/06 414/678
3,469,716 A * 9/1969 Sigman ..... A47F 7/10 414/137.7
3,515,086 A * 6/1970 Sigman ..... A47F 7/10 114/260
3,551,925 A * 1/1971 Reid ..... B63B 23/40 114/373
3,718,316 A * 2/1973 Larralde ..... B66C 13/02 254/277
3,777,691 A * 12/1973 Beale ..... B63C 3/06 114/48
4,022,027 A * 5/1977 Tetzner ..... B63C 3/06 405/3
4,109,896 A * 8/1978 Ragen ..... B63C 3/06 182/144
4,190,013 A * 2/1980 Otis ..... B63C 1/02 114/263
4,195,948 A * 4/1980 Vancil ..... B63C 3/06 405/221
4,207,828 A * 6/1980 Horowitz ..... B63B 43/06 114/125
4,251,993 A * 2/1981 Vancil ..... B63C 3/06 60/537
4,329,082 A * 5/1982 Gillis ..... E02C 5/00 114/48
4,395,178 A * 7/1983 MacDonell ..... B63B 27/30 114/259
4,544,137 A * 10/1985 Johnson ..... B66C 13/02 212/308
4,641,595 A * 2/1987 Pritchett ..... B63C 3/06 114/44
4,678,366 A * 7/1987 Williamson ..... B63C 3/06 405/1
4,686,920 A * 8/1987 Thomas ..... B63C 3/06 114/45
4,705,180 A * 11/1987 Lamer ..... B66C 23/52 212/166
4,832,210 A * 5/1989 Wood, II ..... B63C 3/06 114/368
4,850,741 A * 7/1989 Timmerman ..... B63C 3/06 405/3
5,037,237 A * 8/1991 Anteau ..... B63C 3/06 294/74
5,090,841 A * 2/1992 Penick, Jr. ..... B63C 3/06 114/45
5,099,778 A * 3/1992 Palen ..... B63C 3/06 114/45
5,131,342 A * 7/1992 Sackett ..... B63C 1/02 114/344
5,140,923 A * 8/1992 Wood ..... B63C 3/06 114/48
5,261,347 A * 11/1993 Mansfield ..... B63C 3/06 114/268
5,427,471 A * 6/1995 Godbersen ..... B63C 3/06 114/48

(56) References Cited

U.S. PATENT DOCUMENTS 5,482,401 A * 1/1996 Spisak ..... B63C 3/06 114/44
5,590,978 A * 1/1997 Urbank ..... B63C 3/06 114/48
5,692,857 A * 12/1997 Ness ..... B63C 3/06 114/44
5,701,834 A * 12/1997 Lyons ..... B63C 3/06 114/48
5,772,360 A * 6/1998 Wood, II ..... B63C 3/06 114/48
5,803,003 A * 9/1998 Vickers ..... B66F 7/02 114/44
5,934,826 A * 8/1999 Mansfield ..... B63C 3/06 114/44
5,947,639 A * 9/1999 Bishop ..... E02C 5/00 212/330
6,174,106 B1 * 1/2001 Bishop ..... E02C 5/00 212/330
6,224,294 B1 * 5/2001 Mansfield ..... B63C 3/06 173/1
6,591,770 B1 * 7/2003 Blackmore ..... B63B 27/36 114/259
6,695,533 B1 * 2/2004 Bulmann ..... B63C 3/06 114/44
6,830,002 B1 * 12/2004 Walker ..... B63C 3/06 114/44
6,904,857 B1 * 6/2005 Holden ..... B63C 3/06 114/51
6,979,149 B1 * 12/2005 Thompson ..... E02C 5/00 405/3
7,444,952 B1 * 11/2008 McGann ..... B63B 59/06 114/222
7,503,274 B2 * 3/2009 Weed ..... B63C 1/02 114/45
7,845,296 B1 * 12/2010 Khachaturian ..... B63B 1/121 114/50
2001/0006590 A1 * 7/2001 Bishop ..... B63C 3/06 405/3
2004/0035343 A1 * 2/2004 Floe ..... B63C 3/06 114/51
2004/0052582 A1 * 3/2004 Becker ..... B63C 3/06 405/3
2005/0058508 A1 * 3/2005 Way ..... B63C 3/06 405/3
2005/0281618 A1 * 12/2005 Thompson ..... E02C 5/00 405/86
2006/0147269 A1 * 7/2006 Spratt ..... B63C 3/06 405/3
2006/0180069 A1 * 8/2006 Stolzer ..... B63C 3/06 114/44
2010/0074686 A1 * 3/2010 Towley, III ..... E02B 3/06 405/26
2010/0239371 A1 * 9/2010 Brown ..... E02C 5/00 405/3
2011/0011320 A1 * 1/2011 Yemington ..... B63B 35/44 114/122
2012/0263534 A1 * 10/2012 Heller ..... G05B 19/106 405/3
2013/0004238 A1 * 1/2013 Doig ..... B63C 3/06 405/3
2013/0139743 A1 * 6/2013 Khachaturian ..... B63C 7/04 114/264
2013/0279982 A1 * 10/2013 Wilberts ..... B63C 3/06 405/3
2014/0017009 A1 * 1/2014 Hey ..... B63C 3/06 405/3
2014/0041569 A1 * 2/2014 Couch, III ..... B63B 1/121 114/259
2014/0044484 A1 * 2/2014 Fay, Sr. ..... E05B 73/007 405/3
2014/0133910 A1 * 5/2014 Barnes ..... B63B 43/04 405/3
2014/0147208 A1 * 5/2014 Devitt ..... B63C 3/06 405/3
2015/0158566 A1 * 6/2015 Doig ..... B63C 3/06 405/7
2016/0024736 A1 * 1/2016 Jauncey ..... B01D 17/0214 210/747.6
2016/0159447 A1 * 6/2016 Parker ..... B63C 3/02 405/3
2017/0190398 A1 * 7/2017 Barnes ..... B63C 1/02
2018/0298754 A1 * 10/2018 Kodaira ..... E02F 7/065

* cited by examiner

HYDRAULIC SHIP LIFT WITH ANTI-OVERTURNING CAPABILITY AND METHOD FOR USING THE SAME

CROSS-REFERENCE TO RELATED APPLICATIONS

This application is a continuation-in-part of International Patent Application No. PCT/CN2016/090815 with an international filing date of Jul. 21, 2016, designating the United States, now pending, and further claims foreign priority benefits to Chinese Patent Application No. 201610027194.3 filed Jan. 16, 2016. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The present disclosure relates to a hydraulic ship lift with anti-overturning capability and a method for using the same.

Description of the Related Art

Hydraulic ship lifts are used to raise or lower a ship with the aid of hydraulic power. In use, the ship reception chamber of the hydraulic ship lift often suffers unbalanced loads and tends to tilt. This leads to the shift of the gravity center of the ship, and may lead to catastrophic overturn.

As shown in FIG. 1 and FIG. 2, when the ship reception chamber is in a water-free operating state, regardless of whether it is tilted or horizontal, the gravity centers of the loads and the ship reception chamber are unchanged, and the loads of the ship reception chamber acting on the hoisting points are essentially the same (F1=F2).

As shown in FIG. 3 and FIG. 4, when the ship reception chamber is filled with water and stays horizontal, the gravity centers of the ship reception chamber and the water body load are located at the center of the ship reception chamber, and the loads of the ship reception chamber acting on the hoisting points are essentially the same (F1=F2); however, when the ship reception chamber is tilted, the water body load of the ship reception chamber moves, so that the gravity centers of the ship reception chamber and the water body load change, and accordingly the loads of the ship reception chamber acting on the hoisting points change (F1 is larger than F2), further increasing the tilt of the ship reception chamber. This situation constitutes a positive feedback phenomenon which poses a risk of overturning the ship lift with the ship.

SUMMARY OF THE INVENTION

It is an objective of the present disclosure to provide a hydraulic ship lift with anti-overturning capability and an operating method thereof, so as to solve the problem that a ship reception chamber of existing hydraulic ship lifts tilts when being loaded with water.

In the present disclosure, a mechanical synchronous driving system, a hydraulic driving system and a ship reception chamber guiding system of the traditional hydraulic ship lift are upgraded to be a mechanical synchronizing system, a self-feedback stabilizing system and a stabilizing and equalizing hydraulic driving system, respectively, thereby forming a hydraulic ship lift with anti-overturning capability.

Through the combination of these systems and their joint actions, the problem that the hydraulic ship lift cannot carry out the lifting operation due to the tilt of a water-loaded ship reception chamber is solved.

One objective of the present disclosure is achieved through the following technical schemes: a hydraulic ship lift with anti-overturning capability comprises a mechanical synchronizing system, a stabilizing and equalizing hydraulic driving system, and a self-feedback stabilizing system.

The stabilizing and equalizing hydraulic driving system comprises first resistance equalizing members arranged at corners of branch water pipes or/and second resistance equalizing members arranged at bifurcated pipes, circular forced ventilating mechanisms respectively arranged at the front of water delivery valves of water delivery main pipe and pressure-stabilizing and vibration-reducing boxes arranged behind the water delivery valves.

Each guide wheel of the self-feedback stabilizing system is fixed on the ship reception chamber through a supporting mechanism, the supporting mechanism comprises a base connected to the ship reception chamber, a support articulated on the base, a flexible member fixedly arranged between the support and the base, a limiting stopper arranged on the outer side of the flexible member, and a guide wheel arranged on the support and capable of rolling along a corresponding guide rail. Through the joint actions of the mechanical synchronizing system, the stabilizing and equalizing hydraulic driving system and the self-feedback stabilizing system of the ship reception chamber, a problem that the ship reception chamber of the hydraulic ship lift cannot regularly carry out lifting operation caused by the fact that the ship reception chamber with water tilts is solved, the overall anti-overturning capability of the hydraulic ship lift is improved, and safe, stable and reliable operation of the hydraulic ship lift is ensured.

The self-feedback stabilizing system comprises the guide rails symmetrically arranged on the side walls of the lock chamber and a plurality of guide wheels symmetrically arranged at corresponding upper part and lower part of the ship reception chamber, the guide wheels match the guide rails on the side walls of the lock chamber, and each guide wheel is fixed on the ship reception chamber through the supporting mechanism.

In each supporting mechanism of the self-feedback stabilizing system, the support comprises two oppositely arranged triangular plates, right-angle parts of the two triangular plates are fixed on a bulge on the inner side of the base through a hinge shaft, the flexible member is arranged between horizontal outer end and the outer side of the base, the flexible member is a spring specifically, and the guide wheel is fixedly arranged between the two triangular plates through an axle above the right-angle parts, so the flexible member helps the support to swing around the hinge shaft in order to release jolt caused by an uneven guide rail when the guide wheel meets the uneven guide rail in a rolling procedure, and meanwhile, due to matching of the guide rail and the guide wheel, an overturning torque is automatically provided to perform active correction on the ship reception chamber, thereby preventing the ship reception chamber from tilt.

In the self-feedback stabilizing system, two of the guide rails are respectively arranged along the inner walls of the two sides of the lock chamber, and total four guide rails are arranged; the left side wall and the right side wall of each guide rail match four supporting mechanisms, including two supporting mechanisms at the upper part of the ship reception chamber and two supporting mechanisms at the lower part of the ship reception chamber; and after the ship reception chamber generates tilt under unbalanced loads, due to the matching of the guide rail and the guide wheel, the overturning torque is automatically provided to perform the active correction on the ship reception chamber, thereby preventing the ship reception chamber from tilt, limiting the generated tilt, preventing the tilt of the ship reception chamber from continuously increasing, and ensuring that the hydraulic ship lift stably, safely and reliably operates.

In the self-feedback stabilizing system, horizontal metal plates or right-angle plates are correspondingly arranged on the left side wall and the right side wall of each guide rail, and the horizontal metal plates or side plates of the right-angle plates match the four supporting mechanisms, including the two supporting mechanisms at the upper part of the ship reception chamber and the two supporting mechanisms at the lower part of the ship reception chamber, so as to improve the flatness of the guide rail.

The stabilizing and equalizing hydraulic driving system comprises vertical shafts, floats arranged in the vertical shafts, a water delivery main pipe with water delivery valves and a plurality of branch water pipes, the lower ends of the branch water pipes are connected to the water delivery main pipe, the branch water pipes consist of straight pipes at the lower parts, angle pipes and/or bifurcated pipes at the middle parts, and straight pipes at the upper parts, water outlet ends of the straight pipes at the upper parts are located at the bottoms of the vertical shafts correspondingly, energy dissipaters are respectively arranged at the water outlet ends of the straight pipes, and the vertical shafts are communicated with each other through water level equalizing galleries.

In the stabilizing and equalizing hydraulic driving system, the bottom of each float is a cone of 120 degrees, and a clearance ratio of the vertical shaft to the float is kept between 0.095 and 0.061 to improve hydrodynamic characteristic change and hydrodynamic output stability of the stabilizing and equalizing hydraulic driving system.

In the stabilizing and equalizing hydraulic driving system, each energy dissipater comprises upright rods arranged at the bottom of the vertical shaft at intervals and arranged on the circumference of an water outlet end opening of the straight pipe, and a horizontal baffle arranged at the upper ends of the upright rods to ensure that water, which rushes upwards, only can flow downwards and then flows into the vertical shaft through gaps among the upright rods under the action of the horizontal baffle, thereby reducing the flow velocity of the water, dissipating water energy, reducing impact force of water flow, improving water flow conditions of the bottom of the float, and preventing the float from waggling caused by the fact that the water flow directly impacts the bottom of the float.

In the stabilizing and equalizing hydraulic driving system, each first resistance equalizing member is a right-angle elbow, and a closed pipe head extending downwards is arranged below a right-angle part of the right-angle elbow, thereby ensuring that the flow rate of each branch water pipe in a narrow vertical space is equal, and furthest ensuring that the flow rate of each branch water pipe into the corresponding vertical shaft is the same and meets equal resistance setting requirements.

In the stabilizing and equalizing hydraulic driving system, each second resistance equalizing member is a solid or hollow cone with a large upper part and a small lower part, the upper end of the cone is fixed on the wall of a horizontal pipe of the bifurcated pipe, and the lower end of the cone extends into an upright pipe of the bifurcated pipe downwards, thereby ensuring that the flow rate of each branch water pipe in the narrow vertical space is equal, and furthest ensuring that the flow rate of each branch water pipe into the corresponding vertical shaft is the same and meets equal resistance setting requirements.

In the stabilizing and equalizing hydraulic driving system, each circular forced ventilating mechanism comprises a ventilating ring pipe fixed at the exterior of the water delivery main pipe, a first through hole is formed in the inner side wall of the ventilating ring pipe, the first through hole is communicated with a second through hole formed in the wall of the water delivery main pipe, a third through hole is formed in the outer side wall of the ventilating ring pipe, the third through hole is connected to an air supply pipe, and the air supply pipe is connected to an air source, so that pressured air is filled into the ventilating ring pipe through the air supply pipe and then is filled into the water delivery main pipe through the first through hole and the second through hole, that is, air is mixed into the water, as a result, problems of cavitation and vibration of the water delivery valves of the stabilizing and equalizing hydraulic driving system due to high water level difference under the non-constant action are solved, pressure fluctuation is reduced, a relative cavitation number of the valve is reduced from 1.0 to 0.5, a large-open-degree opening time of the valve is advanced, and water delivery efficiency is improved by more than 60%.

A plurality of first through holes and a plurality of third through holes on the ventilating ring pipe, and a plurality of second through holes on the water delivery main pipe are arranged at intervals, each third through hole is connected to an air supply main pipe through a corresponding air supply branch pipe, and the air supply main pipe is connected to the air source, thereby uniformly supplying the air to the ventilating ring pipe and the water delivery main pipe in multiple paths and multiple points through the air supply branch pipes.

In the stabilizing and equalizing hydraulic driving system, each pressure-stabilizing and vibration-reducing box comprises a housing and an outer beam system, a cavity is formed in the housing, water inlets and a water outlet are formed in the housing, the outer beam system is arranged on the outer wall of the housing, and inner beam system fences are arranged in the cavity of the housing at intervals; each inner beam system fence comprises a hollow plate formed by crisscrossed vertical rods and horizontal rods to match the shape of the cross section of the cavity of the housing, and tension diagonals are arranged in hollowed parts of the hollow plate to reduce disturbance of the inner beam system fence to the water flow to the greatest extent while meeting high-intensity requirements.

In each pressure-stabilizing and vibration-reducing box, the crisscrossed vertical rods and horizontal rods, and the tension diagonals are solid or hollow round tubes, and groove-shaped reinforcing plates are arranged at crisscrossed parts of the vertical rods and the horizontal rods; and cushion plates are arranged at connection parts between the inner beam system fences and the side walls of the cavity of the housing and connection parts between the inner beam system fences and the bottom walls of the cavity of the housing, thereby facilitating connection with the walls of the cavity of the housing, reducing disturbance to the water flow, and meeting hydrodynamic requirements.

A manhole for overhauling is formed in the housing of the pressure-stabilizing and vibration-reducing box, a gas collection groove is arranged at the back part of the interior of the housing, exhaust holes are formed in the top of the gas collection groove, and the exhaust holes are connected to an exhaust pipe.

The outer beam system of the pressure-stabilizing and vibration-reducing box coats the whole outer wall of the housing, the outer beam system comprises four main cross beam plates, a plurality of secondary cross beam plates, a plurality of vertical beam plates and a plurality of horizontal beam plates, the main cross beam plates have the same height and are arranged at intervals, the secondary cross beam plates are located between each pair of the main cross beam plates and are shorter than the main cross beam plates, the vertical beam plates are vertical to the main cross beam plates and the secondary cross beam plates, have the same height and are arranged at intervals, the horizontal beam plates have the same width and length and are arranged at intervals, and those three groups of the beam plates are in mutually interlacing connection to form the outer beam system; and a sunken variable-cross-section beam plate set is arranged on a part, located at a water inlet, of the outer beam system, and the outer side of the variable-cross-section beam plate set is level with the end face of a flange.

Three water inlets on a water feeding side of the pressure-stabilizing and vibration-reducing box are connected to the water delivery main pipe respectively through the corresponding water delivery valves, wherein the water delivery valve at the middle part is a main valve, the water delivery valves on the two sides are auxiliary valves, and the circular forced ventilating mechanisms are respectively arranged at parts, located at the front of the one main valve and the two auxiliary valves, of the water delivery main pipe, so that the auxiliary valves with relatively smaller flow rate of delivered water and relatively better cavitation resistance control the ship reception chamber to operate at the low speed (during butt joint), and the main valve with relatively larger flow rate of the delivered water increases the operating speed of the ship reception chamber at the normal lifting stage, resulting in elimination of influence of non-constant flow generated by the stabilizing and equalizing hydraulic driving system to the stability of the operating speed of the ship reception chamber.

The mechanical synchronizing system comprises a plurality of wire ropes connected to a plurality of parts of two sides of a ship reception chamber in a lock chamber, the other ends of the wire ropes are fixed at the tops of vertical shafts after respectively rounding drums correspondingly arranged at the top and pulleys arranged on floats in the vertical shafts, and the drums are connected to each other through synchronizing shafts and couplings.

In the mechanical synchronizing system, the drums, the couplings and the synchronizing shafts respectively and correspondingly form two rows with the wire ropes on the two sides of the ship reception chamber, and the two rows are connected to horizontal synchronizing shafts through bevel gear pairs and the couplings to form a rectangular frame connection, thereby actively generating anti-overturning moment for the ship reception chamber due to minor deformations of the synchronizing shafts and the horizontal synchronizing shafts.

A conventional brake is arranged on each drum of the mechanical synchronizing system, so, when the ship reception chamber tilts under unbalanced loads, the anti-overturning moment for the ship reception chamber can be actively generated due to minor deformation of the mechanical synchronizing system in order to control a tilt of a ship reception chamber and reduce synchronizing shaft torque; and when the tilt of the ship reception chamber or the torque of the synchronizing shaft reaches a set value, the brake lock the drum to ensure the integral safety of the ship lift.

The hydraulic ship lift with anti-overturning capability, provided by the present disclosure, incorporates the following principles and methods.

For the mechanical synchronizing system, the stabilizing and equalizing hydraulic driving system and the self-feedback stabilizing system, which form the hydraulic ship lift with anti-overturning capability of the present disclosure, their combined anti-overturning capability comprises the following three stages:

(1) at the first stage, a tilt of a ship reception chamber is $0 \leq \Delta < \theta R$;

at this stage, the clearance of the mechanical synchronizing system is not eliminated, so the mechanical synchronizing system does not fully exert the anti-overturning capability, the self-feedback stabilizing system bears initial overturning moment of the ship reception chamber to maintain the ship reception chamber stable, and at this stage, anti-overturning moment provided by the self-feedback stabilizing system fulfills the following formula:

$$K_d \times \Delta + M_{d0} = M_d > \gamma_d \times (M_c + M_w) = \gamma_d \times (K_c \times \Delta + M_w)$$

overall anti-overturning rigidity of the self-feedback stabilizing system fulfills the following formula:

$$K_d > \gamma_d \times \left( K_c + \frac{M_w - M_{d0}/\gamma_d}{\Delta} \right)$$

in the formulas:

overturning moment generated by a tilted ship reception chamber is $M_c = K_c \times \Delta$, and its unit is kN·m;

overturning rigidity of the ship reception chamber is $K_c$ and its unit is kN;

a total tilt of the ship reception chamber is $\Delta$ and its unit is m;

initial overturning moment of the ship reception chamber generated by the stabilizing and equalizing hydraulic driving system is $M_w$ and its unit is kN·m;

a total overturning moment of the ship reception chamber is $M_c + M_w = K_c \times \Delta + M_w$ and its unit is kN·m;

anti-overturning moment generated by the self-feedback stabilizing system is $M_d = K_d \times \Delta + M_{d0}$ and its unit is kN·m;

pre-loading anti-overturning moment of the self-feedback stabilizing system is $M_{d0}$ and its unit is kN·m;

overall anti-overturning rigidity of the self-feedback stabilizing system is $K_d$ and its unit is kN;

a safety coefficient $\gamma_d$ of the self-feedback stabilizing system is 1.5-2.0;

the stabilizing and equalizing hydraulic driving system eliminates unbalanced loads of the ship reception chamber and disturbance of the water body in the ship reception chamber by reducing vertical shaft water level difference and operating speed fluctuation of the ship reception chamber so as to reduce the value of the initial overturning moment of the ship reception chamber $M_w$, and in FIG. 5, it is expressed to reduce the value of initial disturbance overturning moment A of an AB overturning moment curve of the ship reception chamber; and pre-loads of the self-feedback stabilizing system decide the value of $M_{d0}$, and the anti-overturning rigidity $K_d$ decides the value of the anti-overturning moment resisting the ship reception chamber;

(2) at the second stage, the tilt of the ship reception chamber is $\theta R \leq \Delta < \Delta_{max}$;

this stage is from a moment that the clearance of the mechanical synchronizing system is eliminated to a moment that the tilt of the ship reception chamber is smaller than a designed allowable limit tilt value $\Delta_{max}$; at this stage, the self-feedback stabilizing system and the synchronizing shafts of the mechanical synchronizing system jointly bear an anti-overturning capability to the ship reception chamber, wherein the synchronizing shafts of the mechanical synchronizing system exert the main anti-overturning capability, and a proportion of the anti-overturning capability achieved by both of the self-feedback stabilizing system and the mechanical synchronizing system is related to the rigidity $K_d$ and $K_t$ of the self-feedback stabilizing system and the mechanical synchronizing system; total anti-overturning moments of the self-feedback stabilizing system and the mechanical synchronizing system fulfill the following formula:

$$K_d \times \Delta + M_{d0} + K_T \times (\Delta - \theta R) = M_d + M_T > (\gamma_d + \gamma_T) \times (M_c + M_w) = (\gamma_d + \gamma_T) \times (K_c \times \Delta + M_w)$$

an overall anti-overturning rigidity of the mechanical synchronizing system fulfill the following formula:

$$K_T > \frac{(\gamma_d + \gamma_T) \times (K_c \times \Delta + M_w) - K_d \times \Delta - M_{d0}}{(\Delta - \theta R)}$$

in the formulas:

anti-overturning moment generated by the synchronizing shafts of the mechanical synchronizing system is $M_T = K_T \times (\Delta - \theta R)$ and its unit is kN·m;

clearance of the mechanical synchronizing system is $\theta$ and its unit is radian;

radius of each drum is R and its unit is m;

overall anti-overturning rigidity of the mechanical synchronizing system is $K_T$ and its unit is kN;

a safety coefficient $\gamma_T$ of the mechanical synchronizing system is 6-7;

the clearance $\theta R$ of the mechanical synchronizing system decides a position, at which the mechanical synchronizing system starts exerting the anti-overturning capability, and in FIG. 5, it is expressed to be the value of an E value; the overall anti-overturning rigidity $K_T$ of the mechanical synchronizing system decides the value of the anti-overturning moment of the ship reception chamber, and in FIG. 5, it is expressed to be slope of an EF anti-overturning moment curve; and the larger the overall anti-overturning rigidity $K_T$ is, the larger the slope is, and the stronger the system anti-overturning capability is;

(3) at the third stage, the tilt of the ship reception chamber is $\Delta \geq \Delta_{max}$;

when the tilt of the ship reception chamber exceeds a designed allowable maximum tilt value $\Delta_{max}$, the self-feedback stabilizing system exerts a tilt of a ship reception chamber limiting function; continuously increased overturning moment of the ship reception chamber is exerted on the mechanical synchronizing system; at this stage, the stabilizing and equalizing hydraulic driving system is closed, the ship reception chamber of the ship lift stops operating, safety devices on the drums of the mechanical synchronizing system start to operate, the continuously increased overturning moment of the ship reception chamber is born by the safety devices on the drums; and drum braking force fulfill the following formula:

$$F_z \geq \gamma_z \times F_c$$

in the formula:

total drum braking force is $F_z$ and its unit is kN;

total weight of the water body in the ship reception chamber is $F_c$ and its unit is kN; and a safety coefficient $\gamma_z$ of the drum braking force is 0.4-1.0.

The mechanical synchronizing system fulfill the following principles and methods:

the mechanical synchronizing system has double functions of overturning capability and transferring and equalizing unbalanced loads of the ship reception chamber, the system actively generates anti-overturning moment to the ship reception chamber through minor deformation of the synchronizing shafts, and when the tilt of the ship reception chamber and the torque of the synchronizing shaft reaches a designed value, the brakes arranged on the drums lock the drums, thereby ensuring the integral safety of the ship lift;

it is defined that: in the mechanical synchronizing system, the two rows of drums, the couplings, the synchronizing shafts, the bevel gear pairs, the couplings and the horizontal synchronizing shafts are completely symmetric, the ship reception chamber is fully leveled, stress and friction of each drum and each wire rope are totally the same, and rigidity influence from the ship reception chamber and the wire ropes are ignored, so that the rigidity and the intensity of the mechanical synchronizing system fulfill the following principles and methods, which are specifically as follows:

I. Rigidity Setting Method maximum tilt load $\Delta P$ acting on the mechanical synchronizing system by the tilted ship reception chamber is calculated according to the following formula:

$$\Delta P = \frac{(\Delta h + \Delta h_0) L_c B_c \rho g}{24} + \frac{M_b + M_p}{2L_c} \quad (1)$$

in the formula:

$\Delta h$ is a tilt of a ship reception chamber caused by deformation of the synchronizing shafts under unbalanced loads and clearance sum of the synchronizing shafts, and its unit is m;

$\Delta h_0$ is a tilt of a ship reception chamber caused by machining and mounting errors of the drums, wire ropes and the like when the ship reception chamber lifts up and down, and its unit is m;

$L_c$ is length of the ship reception chamber and its unit is m;

$B_c$ is width of the ship reception chamber and its unit is m;

$\rho$ is density and its unit is $kg/m^3$;

g is gravitational acceleration and its unit is $m/s^{-2}$;

$M_b$ is overturning moment caused by water surface fluctuation of the ship reception chamber and its unit is kN·m;

$M_p$ is overturning moment caused by eccentric loads of the ship reception chamber and its unit is kN·m;

when the tilt $\Delta h$ of the ship reception chamber is caused by the deformation of the synchronizing shafts under unbalanced loads and the clearance sum of the synchronizing shafts, anti-overturning force $\Delta F$, which is acting on the ship reception chamber through the drums, of the mechanical synchronizing system is calculated according to the following formula:

$$\Delta F = \frac{\Delta h - \theta_2 R + 4M_f R\sum_{i=1}^{n}\frac{L_i}{GI_{pi}}}{R^2\sum_{i=1}^{n}\frac{L_i}{GI_{pi}}} \quad (2)$$

in the formula:

ΔF is anti-overturning force acting on the ship reception chamber and its unit is kN;

Δh is the tilt of the ship reception chamber caused by deformation of the synchronizing shafts under unbalanced loads and clearance sum of the synchronizing shafts, and its unit is m;

$\theta_2$ is total clearance among the synchronizing shafts and its unit is radian;

R is radius of the drum and its unit is m;

$M_f$ is torque generated by friction force of a single drum and its unit is kN·m;

G is shearing modulus of elasticity and its unit is kPa;

$L_i$ is length of the i-th synchronizing shaft and its unit is m;

$I_{pi}$ is polar moment of inertia of the section of the i-th synchronizing shaft, wherein:

$$I_p = \frac{\pi D^4}{32}(1 - a^4)$$

in the formula:

D is outer diameter of the synchronizing shaft;

a is inner diameter/outer diameter of a hollow synchronizing shaft; if it is a solid synchronizing shaft, the inner diameter is equal to 0, namely a=0;

therefore, in the absence of the intensity loss of the synchronizing shaft, it can be seen that:

(1) ΔF>ΔP, a tilt of a ship reception chamber Δh is reduced when the deformation of the synchronizing shafts under unbalanced loads and the clearance sum of the synchronizing shafts cause the ship reception chamber to incline by Δh, and anti-overturning force ΔF acting on the ship reception chamber by the drums is larger than maximum tilt load ΔP acting on the mechanical synchronizing system by the tilted ship reception chamber;

(2) ΔF<ΔP, when the tilt Δh of the ship reception chamber is continuously increased, the synchronizing shafts need to generate larger torsional deformation and generate larger resistance force, so that the balance of the ship reception chamber can be ensured;

(3) ΔF=ΔP, when the tilt Δh of the ship reception chamber is equal to the maximum tilt load ΔP acting on the mechanical synchronizing system by the tilted ship reception chamber, the ship reception chamber is stable, so:

$$\beta = \frac{L_c B_c \rho g}{24},\ \delta = R\sum_{i=1}^{n}\frac{L_i}{GI_{pi}}$$

according to the condition that the ship reception chamber is stable, namely ΔF=ΔP, the following formula is fulfilled:

$$\Delta h = \frac{\theta_2 R}{1-\beta\delta R} + \frac{\Delta h_0 \beta\delta R}{1-\beta\delta R} + \frac{\delta R(M_b + M_p)}{2L_c(1-\beta\delta R)} - \frac{4\delta M_f}{1-\beta\delta R} \quad (3)$$

due to Δh≥0, the total rigidity of the mechanical synchronizing system is defined as $$K = \frac{1}{\sum_{i=1}^{n}\frac{L_i}{GI_{pi}}},$$

and an essential condition which makes the formula (4) workable is 1>βδR, that is, an essential condition, under which the mechanical synchronizing system can keep the ship reception chamber stable, is:

$$K > \frac{L_c B_c \rho g R^2}{24} \quad (4)$$

when the ship reception chamber lifts up and down, the allowable maximum tilt of a ship reception chamber is $\Delta h_{max}$, so that the rigidity of the mechanical synchronizing system further fulfills:

$$\gamma_1(\theta_2 R + \Delta h_0) + \gamma_2(M_h + M_p) - \gamma_3 M_f \leq \Delta h_{max} \quad (5)$$

in formula:

(1) $\gamma_1(\theta_2 R + \Delta h_0)$ is tilt generated by manufacturing errors, namely a tilt of a ship reception chamber caused by the clearance of the mechanical synchronizing system, wire rope errors and the like, wherein $$\gamma_i = \frac{1}{1-\beta\delta R}$$

is defined as manufacturing error tilt coefficient, $\gamma_1$ is defined as coefficient related to the dimension of the ship reception chamber and the rigidity of the synchronizing shaft, γ1∈[1,+∞) can be seen by combining with the formula (5), and $\gamma_1$ is a numerical value larger than or equal to 1 according to the definition of the coefficient $g_1$; the larger the rigidity of the synchronizing shaft is, the smaller the value of $\gamma_1$ is, but the value of $\gamma_1$ is not smaller than 1; and when the rigidity of the synchronizing shaft is infinitely large, $\gamma_1$=1, and at this point, the maximum a tilt of a ship reception chamber caused by the manufacturing errors is $\theta_2 R + \Delta h_0$; therefore, $\gamma_1$ exerts an enlarging function to the tilt of the ship reception chamber caused by the manufacturing errors, wherein the smaller the rigidity of the synchronizing shaft is, the larger the enlarging function to the tilt of the ship reception chamber caused by the manufacturing errors is; and the larger the rigidity of the synchronizing shaft is, the smaller the enlarging function to the tilt of the ship reception chamber caused by the manufacturing errors is;

(2) $\gamma_2(M_b + M_p)$ is a tilt $\Delta H_2$ of a ship reception chamber caused by the overturning moment, namely a tilt of a ship reception chamber generated under the action of overturning moment caused by water surface fluctuation, ship reception chamber eccentric loads and the like, wherein $$\gamma_2 = \frac{\delta R}{2L(1-\beta\delta R)}$$

is defined as fluctuation tilt coefficient, $\gamma_2 \to 0$ when the rigidity is infinitely large, and at this point, influence on the tilt of the ship reception chamber due to the overturning moment caused by the water surface fluctuation is smaller;

(3) $-\gamma_3 M_f$ is resistance, generated by system friction force, to the tilt of the ship reception chamber, wherein $$\gamma_3 = \frac{4\delta}{1-\beta\delta R}$$

is defined as friction force tilt resistance coefficient, and the larger the system friction force is, the more the reduction of the tilt of the ship reception chamber is helpful;

therefore, the mechanical synchronizing system has the anti-overturning capability, and the rigidity of the synchronizing shafts of the mechanical synchronizing system simultaneously fulfills formula (4) and formula (5);

II Intensity Setting Method maximum torque of the synchronizing shaft $T_N$ during operation of the ship reception chamber is expressed to be:

$$T_N=\varphi_1[M_Q+2L\beta(\theta_2R+\Delta h_0)]-\varphi_3M_f+M_k+M_g=\varphi_1M_Q+\varphi_2(\theta_2R+\Delta h_0)-\varphi_3M_f+M_k+M_g$$

in formula:

$\varphi_1$ is overturning moment coefficient;

$M_Q$ is an overturning moment of a ship reception chamber and its unit is kN·m;

$\varphi_2$ is manufacturing error coefficient;

$\theta_2R+\Delta h_0$ is manufacturing errors of the mechanical synchronizing system;

$\varphi_1M_Q$ represents influence on the torque of the synchronizing shaft due to an overturning moment of a ship reception chamber $M_Q$ generated by water surface fluctuation of the ship reception chamber, eccentric loads of the ship reception chamber and the like;

$\varphi_2(\theta_2R+\Delta h_0)$ represents influence on the torque of the synchronizing shaft due to the manufacturing errors $\theta_2R+\Delta H_0$ of the mechanical synchronizing system after water is loaded to the ship reception chamber;

$\varphi_1M_Q+\varphi_2(\theta_2R+\Delta h_0)$ represents influence on the torque of the synchronizing shaft loads due to the water body in the ship reception chamber;

$-\varphi_3M_f$ reflects resistance of system friction force to the torque of the synchronizing shaft;

$M_k$ reflects internal torque change of the synchronizing shaft generated by the mounting errors and the like when the synchronizing shafts rotate;

$M_g$ reflects initial torque generated to the synchronizing shafts due to unbalance stress of adjacent drums and wire ropes when the ship reception chamber is initially leveled;

when the ship reception chamber without water lifts up and down, influence of both $\varphi_1M_Q+\varphi_2(\theta_2R+\Delta h_0)$ can be ignored, so, when the ship reception chamber without water lifts up and down, the torque of the synchronizing shaft can be expressed to be:

$$T_N=-\varphi_3M_f+M_k+M_g$$

III Clearance and Manufacturing Error Control Conditions

A clearance $\theta_2R$ and manufacturing error tilt $\Delta h_0$ of the mechanical synchronizing system are controlled according to the following conditions:

$$(\theta_2R+\Delta h_0) \le \frac{\Delta h_{max}+\gamma_3M_f-\gamma_2(M_b+M_p)}{\gamma_1} \quad (6)$$

-continued $$(\theta_2R+\Delta h_0) \le \frac{(M_{max}-M_k-M_g)+\varphi_3M_f-\varphi_1M_Q}{2L\beta\varphi_1} \quad (7)$$

in the formulas:

$\Delta h_{max}$ is allowable maximum tilt of a ship reception chamber and its unit is m;

$M_{max}$ is allowable maximum torque of the mechanical synchronizing system and its unit is kN·m; and the meanings of the residual signs are ditto.

Other settings of the mechanical synchronizing system are carried out by routine.

The water delivery main pipe and the plurality of branch water pipes of the stabilizing and equalizing hydraulic driving system fulfills the following principles and methods:

the water delivery main pipe and the branch water pipes incorporate the requirement that water flow inertia length is completely the same, specifically, length and section dimension of a pipe segment from a water delivery main pipe entrance to a corresponding vertical shaft (exit) are completely equal to total length and total section dimension of a corresponding branch water pipe, so as to meet equal inertia setting requirements;

for the branch water pipes, the first resistance equalizing members arranged at the corners of the angle pipes or/and the second resistance equalizing members arranged at the bifurcated pipes fulfill the following principles and methods:

(1) when maximum flow rate of the branch water pipes is smaller than 2 m/s, the first resistance equalizing members reduce a bias water flow condition at the corners of the branch water pipes;

(2) when the maximum flow rate of the branch water pipes is smaller than 4 m/s, the second resistance equalizing members equalize the flow rate at the bifurcated pipes of the branch water pipes;

(3) when the maximum flow rate of the branch water pipes is smaller than 6 m/s, the first resistance equalizing members and the second resistance equalizing members are designed simultaneously;

so, it is used to ensure that the flow rate of each branch water pipe in the narrow and vertical space is the same, and furthest ensure that the flow rate of each branch water pipe into the corresponding vertical shaft is the same and meets equal resistance setting requirements, minimum cross section area of the water level equalizing gallery is calculated by the following method:

$$\omega = K\frac{2C\sqrt{H}}{\mu T\sqrt{2g}} \quad (8)$$

in the formula:

$\omega$ is area of the water level equalizing gallery and its unit is $m^2$;

C is area of adjacent vertical shafts and its unit is $m^2$;

H is allowable maximum water level difference of adjacent vertical shafts, and its unit is m;

$\mu$ is flow rate coefficient of the water level equalizing gallery;

T is maximum water level difference allowable lasting time and its unit is s;

K is safety coefficient of 1.5-2.0; and g is gravitational acceleration and its unit is $m/s^{-2}$.

Due to arrangement of the water level equalizing galleries at the bottoms of the vertical shafts and determination of the minimum cross section area of the water level equalizing gallery, inconsistent water levels among the vertical shafts are regulated, thereby avoiding accumulation of the water level difference among the vertical shafts.

Other settings of the stabilizing and equalizing hydraulic driving system are carried out by routine.

The self-feedback stabilizing system fulfills the following principles and methods:

to improve adaptive capacity of a guide wheel mechanism to guide rail precision, control maximum deformation of the guide wheel mechanism, and prevent ship reception chamber self-feedback stabilizing system failure caused by flexible member failure, the self-feedback stabilizing system fulfills the following principles and methods:

(1) overturning moment after the ship reception chamber tilts is calculated by the following formula:

$$N_{qf}=(1/2\times 2\Delta\times L_c)\times B_c\times(2/3L_c-1/2L_c)\text{ unit: t·m}$$

anti-overturning moment of the guide wheel mechanism is calculated by the following formula:

$$N_{kf}=4\times(2\Delta/L)\times L^*\times K^*\times L^*\text{ unit: t·m}$$

in the foregoing two formulas:

$L_c$ is length of the ship reception chamber and its unit is m;

$B_c$ is width of the ship reception chamber and its unit is m;

L* is an interval of guide wheels on the same side of the guide wheel mechanism, and its unit is m;

K* is rigidity of the flexible members in the guide wheel mechanism and its unit is t/m;

Δ is a tilt of a ship reception chamber and its unit is m; by taking the transverse center line of the ship reception chamber as reference, one end is reduced by "Δ", one end is increased by "Δ", and the height difference of these two ends is "2Δ"; and L is the length of the ship reception chamber.

(2) the rigidity of the flexible members in the guide wheel mechanism fulfills the following formula:

$$K^*=N_{kf}/N_{qf}$$

K*>1 represents that the guide wheel mechanism has an anti-overturning capability;

K*<1 represents that the guide wheel mechanism does not have the anti-overturning capability; and K*=1 represents that the guide wheel mechanism provides an unstable anti-overturning capability.

(3) clearance of the limiting stoppers in the guide wheel mechanism fulfills the following principles and methods:

maximum unevenness of the guide rail is supposed to be δ, so, in the operation procedure, along with the rolling of the guide wheels, rotation displacement at clearance of the guide wheel is:

$$\delta^*=(a^*/b^*)\times\delta$$

to prevent the guide wheel operation from jamming, the following condition is fulfilled:

$$\delta^*>\delta$$

Other settings of the self-feedback stabilizing system are carried out by routine.

The hydraulic ship lift with anti-overturning capability, provided by the present disclosure, has the following advantages and beneficial effects:

(1) due to arrangement of the stabilizing and equalizing hydraulic driving system, flow dividing uniformity of power water flow is effectively improved, water flow entering the vertical shafts is ensured to be more uniform, and then unbalanced loads of the ship reception chamber are reduced; especially due to control on clearance ratio of the energy dissipaters, the vertical shafts and the floats (a range between 0.095 and 0.061), fluctuation of the water body in the vertical shafts to the floats is reduced, speed fluctuation when the ship reception chamber lifts up and down is reduced, and disturbance to the water body in the ship reception chamber due to the stabilizing and equalizing hydraulic driving system is reduced; and due to arrangement of the circular forced ventilating mechanism at the front of the water delivery valves and the pressure-stabilizing and vibration-reducing boxes behind the water delivery valves, operation efficiency of the stabilizing and equalizing hydraulic driving system is improved, and damage of hydrodynamic cavitation to the water delivery valves and the water delivery pipes is reduced. Through the foregoing joint actions, disturbance to the unbalanced loads of the ship reception chamber and the water body in the ship reception chamber due to the stabilizing and equalizing hydraulic driving system of the hydraulic ship lift is effectively reduced, initial overturning moment of the ship reception chamber is reduced, and the operation efficiency of the ship lift is improved.

(2) due to the rigidity and intensity settings and clearance and manufacturing error control of the mechanical synchronizing system, the unbalanced loads of the ship reception chamber can be transferred and equalized, and the anti-overturning capability of the ship lift is improved, that is, minor deformation of the mechanical synchronizing system generates an active anti-overturning moment so as to control the tilt of the ship reception chamber and reduce the torque of the synchronizing shaft; and when the tilt of the ship reception chamber or the torque of the synchronizing shaft reaches a designed value, the brakes on the drums lock the drums, thereby ensuring the integral safety of the ship lift.

(3) due to the self-feedback stabilizing system, before the mechanical synchronizing system eliminates the clearance and fully exerts the anti-overturning capability, the initial overturning moment can be provided for the ship reception chamber to perform active correction on the ship reception chamber; and after the ship reception chamber tilts under the unbalanced loads, a tilt limiting function of the ship reception chamber is achieved to prevent the tilt of the ship reception chamber from continuously increasing, thereby ensuring that the hydraulic ship lift stably, safely and reliably operates.

Due to the joint and combined action of the mechanical synchronizing system, the stabilizing and equalizing hydraulic driving system and the self-feedback stabilizing system, finally the hydraulic ship lift has highly reliable and stable anti-overturning capability under the condition of loading water, thereby ensuring that the hydraulic ship lift safely and reliably operates.

Figure 1:
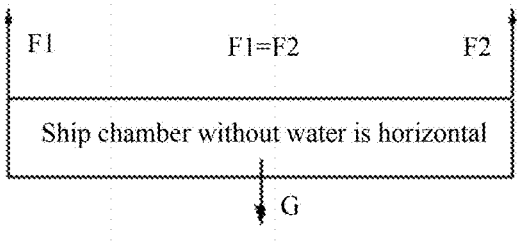
FIG. 1 and FIG. 2 are mechanical analysis diagrams of a ship reception chamber without water.
Figure 2:
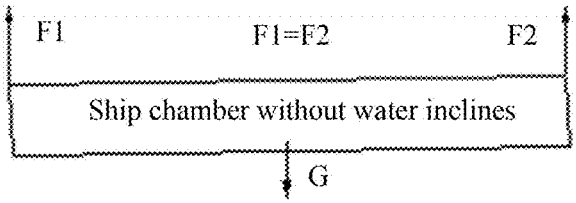
Figure 3:
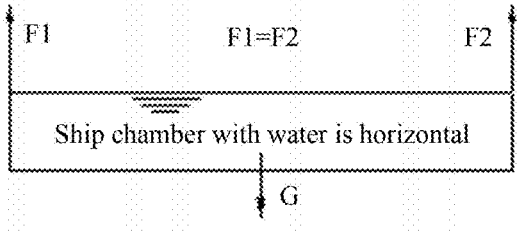
FIG. 3 and FIG. 4 are mechanical analysis diagrams of a ship reception chamber with water.
Figure 4:
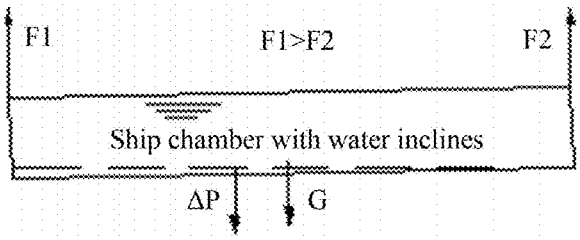

In the drawings, numeric symbols are as follows: 1—lock chamber, 11—ship reception chamber, 12—ship, 14—guide rail on the side wall of the lock chamber, 2—mechanical synchronizing system, 21—wire rope, 22—pulley, 24—drum, 25—synchronizing shaft, 26—coupling, 27—brake, 28—bevel gear pair, 29—horizontal synchronizing shaft, 3—stabilizing and equalizing hydraulic driving system, 31—vertical shaft, 311—float, 32—water delivery main pipe, 327—second through hole, 321—lower-end straight pipe of the branch water pipe, 33—water delivery valve, 324—upper-end straight pipe of the branch water pipe, 323—angle pipe of the branch water pipe, 322—bifurcated pipe of the branch water pipe, 325—energy dissipater, 326—water level equalizing gallery, 36—first resistance equalizing member, 37—second resistance equalizing member, 34—circular forced ventilating mechanism, 341—ventilating ring pipe, 342—first through hole, 343—air supply branch pipe, 344—third through hole, 345—air supply main pipe, 35—pressure-stabilizing and vibration-reducing box, 351—housing, 3511—water inlet, 3512—water outlet, 3513—manhole, 3514—exhaust hole, 3515—gas collection groove, 352—outer beam system, 3521—main cross beam plate, 3522—secondary cross beam plate, 3523—vertical beam plate, 3524—horizontal beam plate, 3525—variable-cross-section beam plate, 353—inner beam system fence, 3531—vertical rod, 3532—horizontal rod, 3533—groove-shaped reinforcing plate, 3534—reinforcing rib, 3535—cushion plate, 3536—tension diagonal, 3537—filler strip, 3538—hollow, 354—flange, 4—self-feedback stabilizing system, 41—base of a guide wheel mechanism, 42—limiting stopper, 43—flexible member, 44—support, 45—guide wheel, and 46—metal horizontal plate.

DETAILED DESCRIPTION OF THE EMBODIMENTS

The following illustrates the present disclosure in detail in conjunction with accompanying drawings and embodiments.

A hydraulic ship lift with anti-overturning capability, provided by the present disclosure, comprises a mechanical synchronizing system 2, a stabilizing and equalizing hydraulic driving system 3 and a self-feedback stabilizing system 4.

Figure 6:
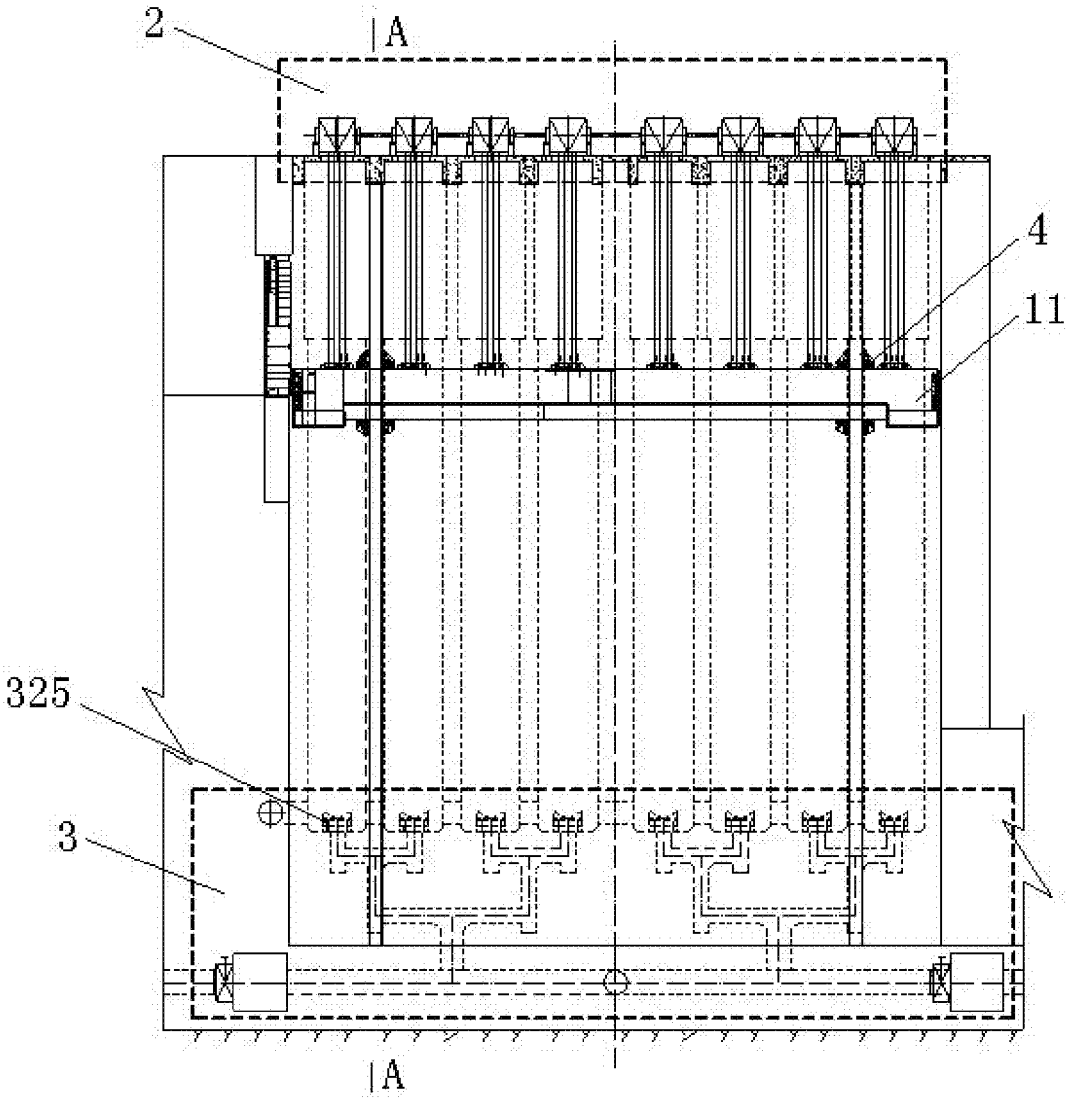
FIG. 6 is a side-view structure diagram of a ship lift.
Figure 7:
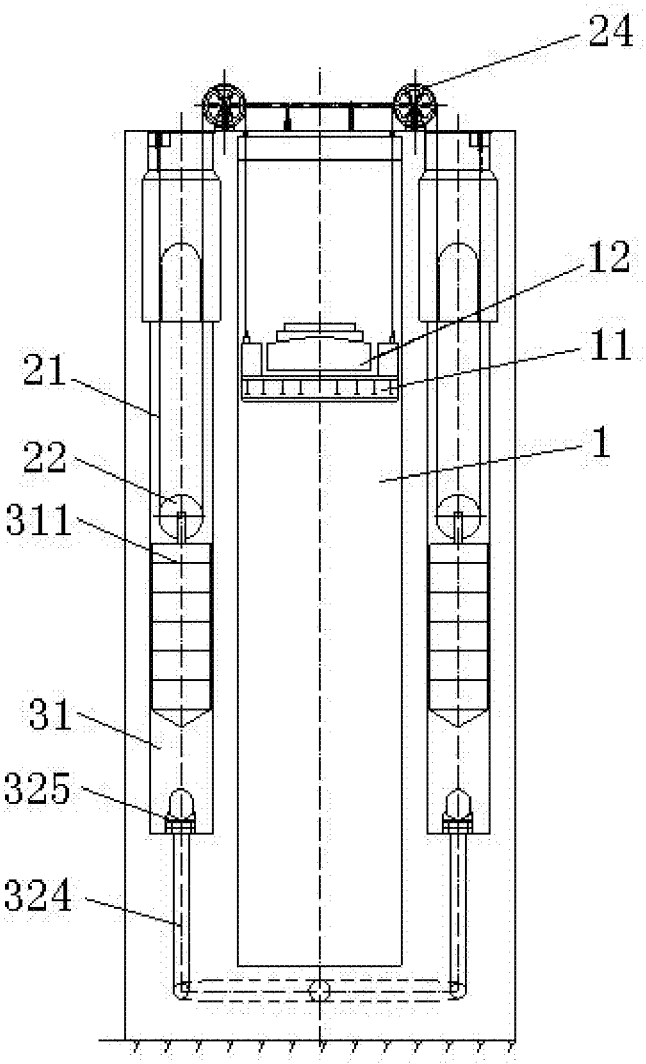
FIG. 7 is an A-A cross section diagram of FIG. 6.
Figure 18:
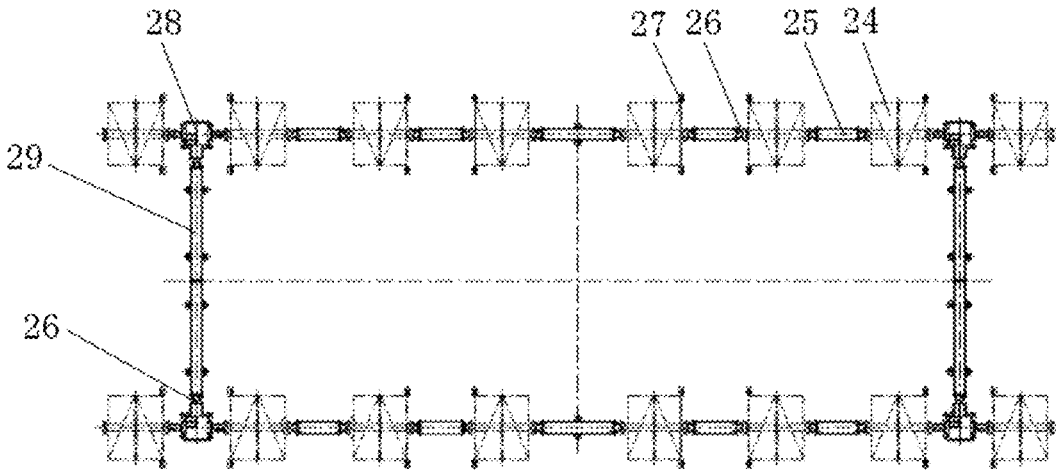
FIG. 18 is a structure diagram of a mechanical synchronizing system.

The mechanical synchronizing system 2 comprises a plurality of wire ropes 21 connected to a plurality of parts of two sides of a ship reception chamber 11 in a lock chamber 1, and the other ends of the wire ropes 21 are fixed at the tops of vertical shafts 31 after respectively rounding drums 24 correspondingly arranged at the top and pulleys 22 arranged on floats 311 in the vertical shafts 31, as shown in FIG. 6 and FIG. 7. The drums 24 are connected to each other through synchronizing shafts 25 and couplings 26, the drums 24, the couplings 26 and the synchronizing shafts 25 respectively and correspondingly form two rows with the wire ropes 21 on the two sides of the ship reception chamber 11, and the two rows are connected to horizontal synchronizing shafts 29 through bevel gear pairs 28 and the couplings 26 to form a rectangular frame connection, thereby actively generating anti-overturning moment for the ship reception chamber 11 due to minor deformations of the synchronizing shafts 25 and the horizontal synchronizing shafts 29; and a conventional brake 27 is arranged on each drum 24 of the mechanical synchronizing system 2, as shown in FIG. 18, so, when the ship reception chamber 11 tilts under unbalanced loads, the anti-overturning moment for the ship reception chamber 11 can be actively generated due to minor deformation of the mechanical synchronizing system 2 to achieve objectives of controlling a tilt of a ship reception chamber and reducing synchronizing shaft torque, and when the tilt of the ship reception chamber or the torque of the synchronizing shaft reaches a set value, the brakes 27 lock the drums 24 to ensure the integral safety of the ship lift.

Figure 19:
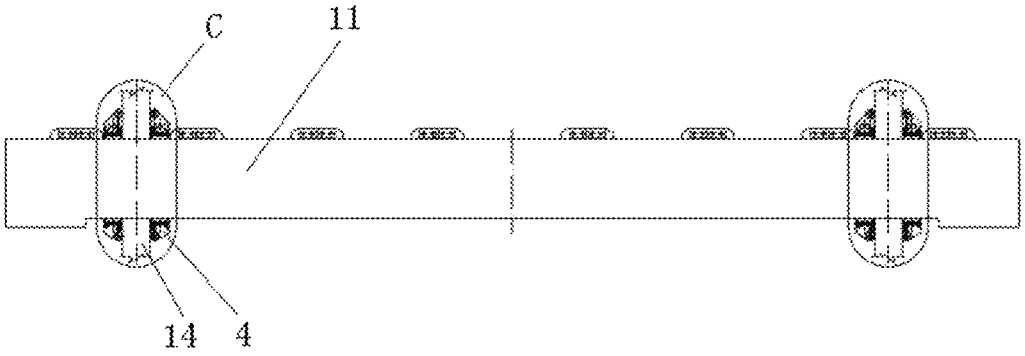
FIG. 19 is a structure diagram of a self-feedback stabilizing system.
Figure 20:
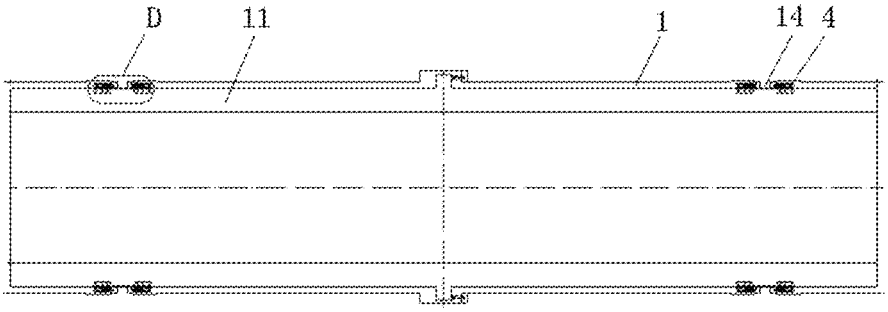
FIG. 20 is a top view of FIG. 19.
Figure 21:
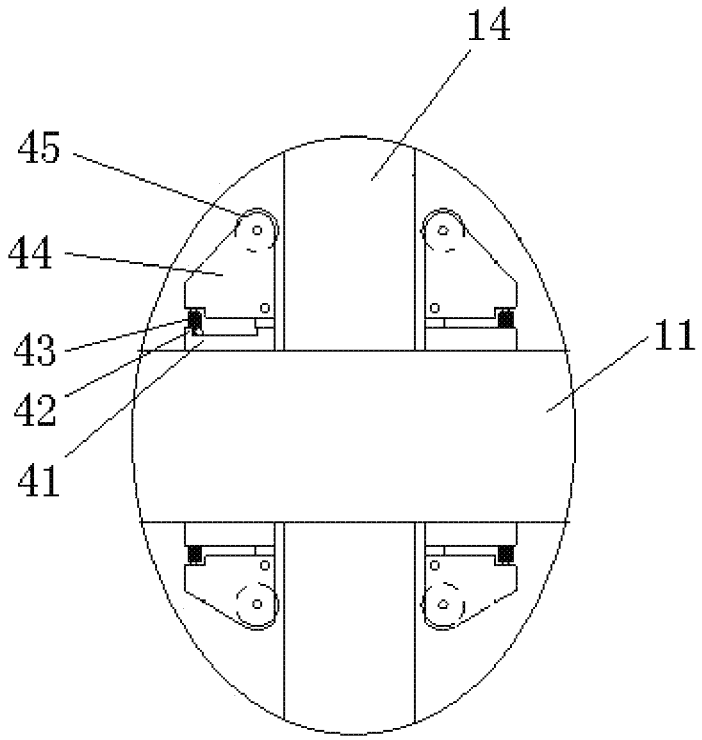
FIG. 21 is an enlarged diagram of a C part in FIG. 19.
Figure 22:
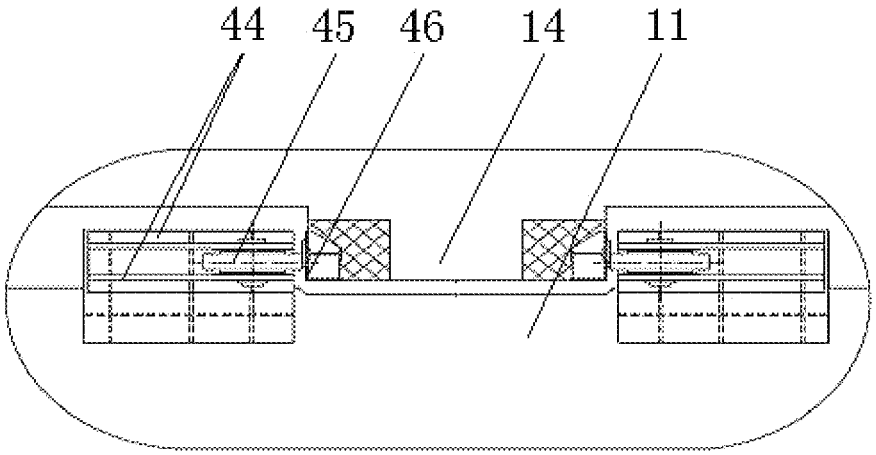
FIG. 22 is an enlarged diagram of a D part in FIG. 20.

The self-feedback stabilizing system 4 comprises guide rails 14 symmetrically arranged on the side walls of the lock chamber 1 and a plurality of guide wheels symmetrically arranged at corresponding upper part and lower part of the ship reception chamber 11, the guide wheels match the guide rails 14 on the side walls of the lock chamber 1, and each guide wheel is fixed on the ship reception chamber 11 through a supporting mechanism; and two of the guide rails 14 are respectively arranged along the inner walls of the two sides of the lock chamber 1, and total four guide rails 14 are arranged, as shown in FIG. 19 and FIG. 20. The left side wall and the right side wall of each guide rail 14 match four supporting mechanisms, including two supporting mechanisms at the upper part of the ship reception chamber 11 and two supporting mechanisms at the lower part of the ship reception chamber 11, as shown in FIG. 21. Horizontal metal plates 46 are correspondingly arranged on the left side wall and the right side wall of each guide rail 14, as shown in FIG. 22, and the horizontal metal plates 46 match the four supporting mechanisms, including the two supporting mechanisms at the upper part of the ship reception chamber 11 and the two supporting mechanisms at the lower part of the ship reception chamber 11, so as to improve the flatness of the guide rail 14. Each supporting mechanism comprises a base 41 connected to the ship reception chamber 11, a support 44 articulated on the base 41, a flexible member 43 fixedly arranged between the support 44 and the base 41, a limiting stopper 42 arranged on the outer side of the flexible member and a guide wheel 45 arranged on the support 44 and rolling along the corresponding guide rail 44; and the support 44 comprises two oppositely arranged triangular plates, right-angle parts of the two triangular plates are fixed on a bulge on the inner side of the base 41 through a hinge shaft, the flexible member 43 is arranged between horizontal outer ends and the outer side of the base 41, the flexible member 43 is a spring, and the guide wheel 45 is fixedly arranged between the two triangular plates through an axle above the right-angle parts, as shown in FIG. 21, so the flexible member helps the support to swing around the hinge shaft in order to release jolt caused by an uneven guide rail when the guide wheel 45 meets the uneven guide rail in a rolling procedure, and meanwhile, due to matching of the guide rail and the guide wheel, an overturning torque is automatically provided to perform active correction on the ship reception chamber, thereby prevent the ship reception chamber from tilt.

Figure 8:
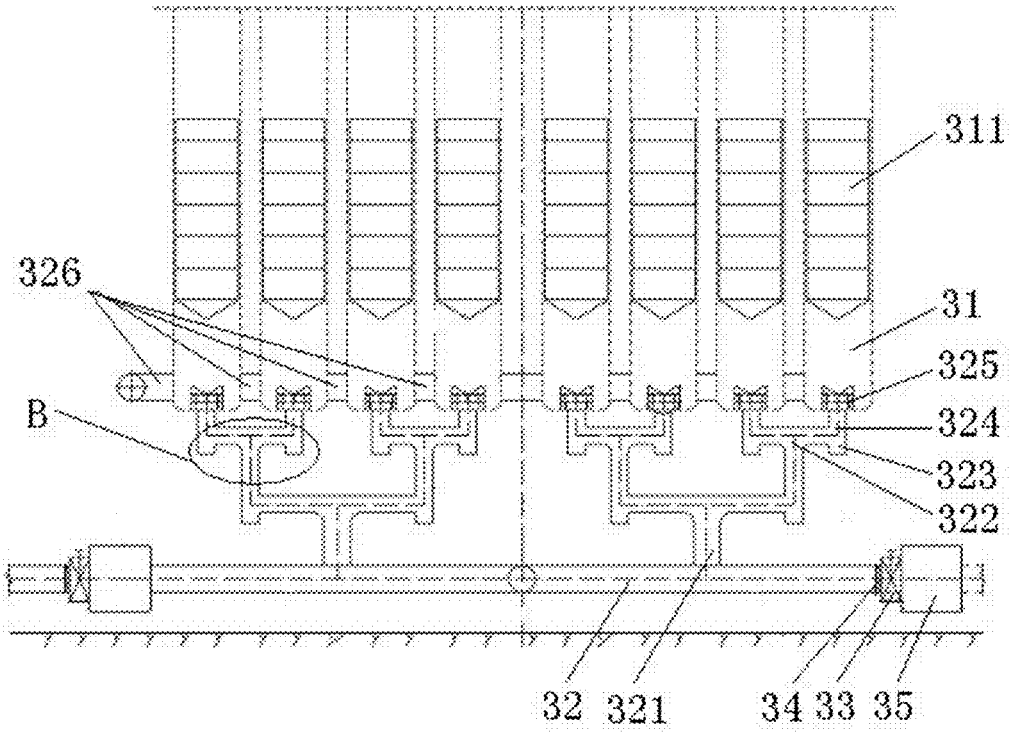
FIG. 8 is a structure diagram of a stabilizing and equalizing hydraulic driving system in FIG. 6.
Figure 9:
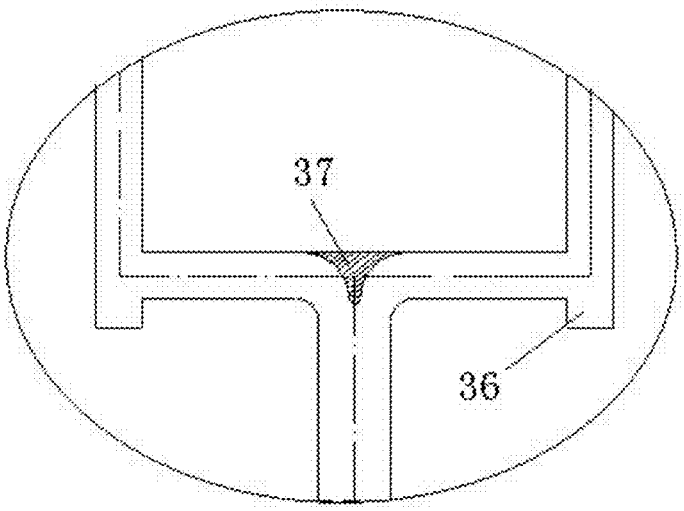
FIG. 9 is an enlarged diagram of a B part in FIG. 8.

The stabilizing and equalizing hydraulic driving system 3 comprises vertical shafts 31, floats 311 arranged in the vertical shafts 31, a water delivery main pipe 32 with water delivery valves 33 and a plurality of branch water pipes, and the lower ends of the branch water pipes are connected to the water delivery main pipe 32; each branch water pipe consists of lower-end straight pipes 321, angle pipes 323 and bifurcated pipes 322 at the middle part, and upper-end straight pipes 324, wherein the lower-end straight pipes 321, the angle pipes 323, the bifurcated pipes 322, and the upper-end straight pipes 324 are classified into the high level and the low level, the lower-end straight pipe 321 at the low level is connected to the water delivery main pipe 21, water outlet ends of the upper-end straight pipes 324 at the high level are located at the bottoms of the vertical shafts 31 correspondingly, energy dissipaters 325 are respectively arranged at the water outlet ends of the upper-end straight pipes 324, and the vertical shafts 31 are communicated with each other through water level equalizing galleries 326; the stabilizing and equalizing hydraulic driving system 3 further comprises first resistance equalizing members 36 arranged at the corners of the angle pipes 323 of the branch water pipes, second resistance equalizing members 37 arranged at the bifurcated pipes 322, circular forced ventilating mechanisms 34 respectively arranged at the front of the water delivery valves 33 of the water delivery main pipe 32 and pressure-stabilizing and vibration-reducing boxes 35 arranged behind the water delivery valves 33, as shown in FIG. 6, FIG. 7 and FIG. 8.

The bottom of each float 311 is a cone of 120 degrees, and a clearance ratio of the vertical shaft 31 to the float 311 is kept between 0.095 and 0.061 to improve hydrodynamic characteristic change and hydrodynamic output stability of the stabilizing and equalizing hydraulic driving system.

Each energy dissipater 325 comprises upright rods arranged at the bottom of the vertical shaft at intervals and arranged on the circumference of an water outlet end opening of the upper-end straight pipe 324, and a horizontal baffle arranged at the upper ends of the upright rods, thereby reducing the water flow velocity of the water outlet end through the horizontal baffle, dissipating water energy, reducing impact force of water flow, improving water flow conditions of the bottom of the float, and preventing the float from waggling caused by the fact that the water flow directly impacts the bottom of the float.

Each first resistance equalizing member 36 is a right-angle elbow, and a closed pipe head extending downwards is arranged below a right-angle part of the right-angle elbow, thereby ensuring that the flow rate of each branch water pipe in a narrow vertical space is equal, and furthest ensuring that the flow rate of each branch water pipe into the corresponding vertical shaft is the same and meets equal resistance setting requirements.

Each second resistance equalizing member 37 is a solid or hollow cone with a large upper part and a small lower part, the upper end of the cone is fixed on the wall of a horizontal pipe of the bifurcated pipe 322, and the lower end of the cone extends into an upright pipe of the bifurcated pipe 322 downwards, thereby ensuring that the flow rate of each branch water pipe in the narrow vertical space is equal, and furthest ensuring that the flow rate of each branch water pipe into the corresponding vertical shaft is the same and meets equal resistance setting requirements.

Figure 10:
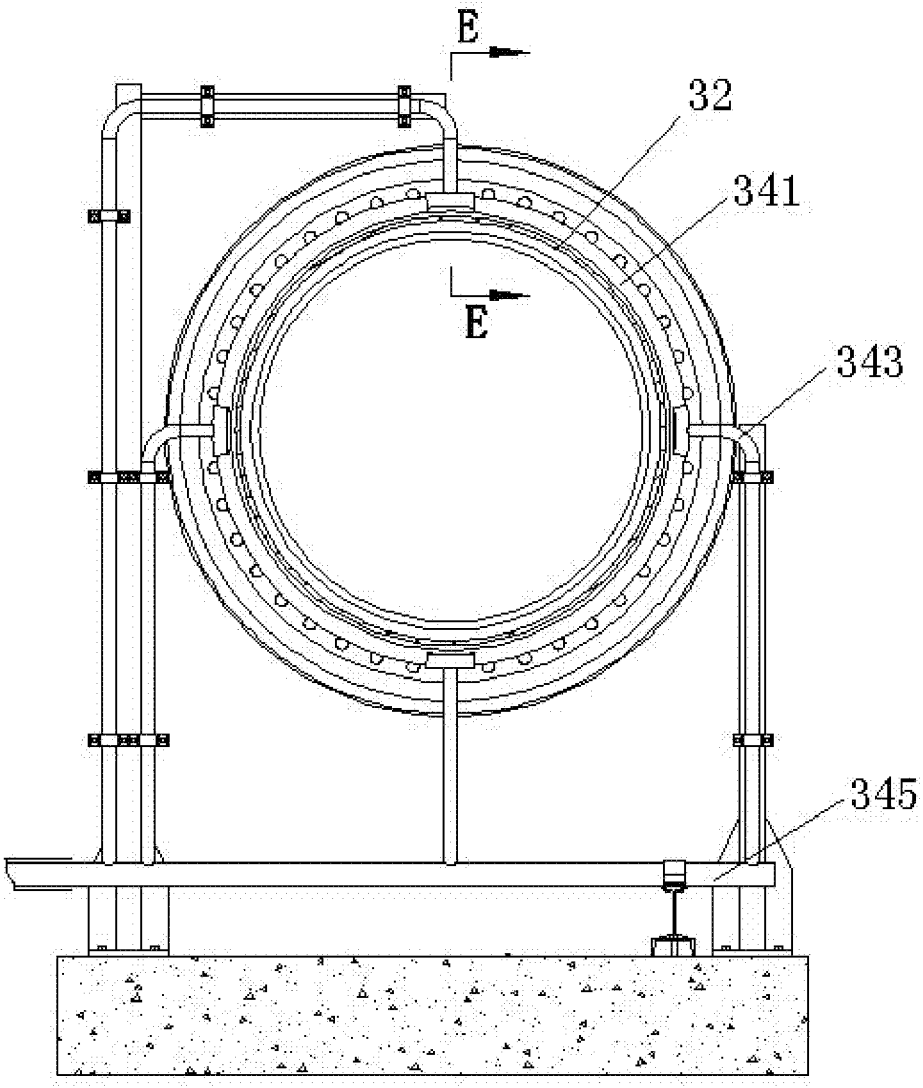
FIG. 10 is a cross-section structure diagram of a circular forced ventilating mechanism in FIG. 8.
Figure 11:
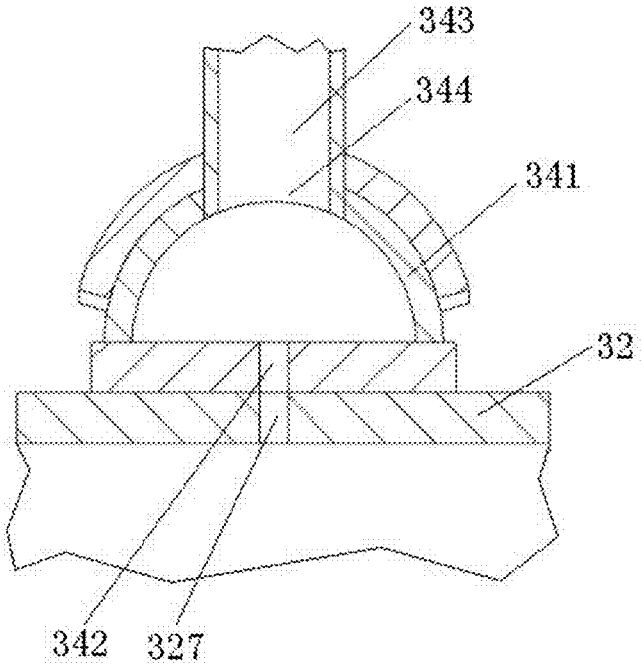
FIG. 11 is an E-E view in FIG. 10.

Each circular forced ventilating mechanism 34 comprises a ventilating ring pipe 341 fixed at the exterior of the water delivery main pipe 32, a first through hole 342 is formed in the inner side wall of the ventilating ring pipe 341, the first through hole 342 is communicated with a second through hole 327 formed in the wall of the water delivery main pipe 32, a third through hole 344 is formed in the outer side wall of the ventilating ring pipe 341, the third through hole 344 is connected to an air supply pipe, and the air supply pipe is connected to an air source, so that pressured air is filled into the ventilating ring pipe 341 through the air supply pipe and then is filled into the water delivery main pipe 32 through the first through hole 342 and the second through hole 327, that is, air is mixed into the water, as a result, problems of cavitation and vibration of the water delivery valves 33 of the stabilizing and equalizing hydraulic driving system due to high water level difference under the non-constant action are solved, pressure fluctuation is reduced, a relative cavitation number of the valve is reduced from 1.0 to 0.5, a large-open-degree opening time of the valve is advanced, and water delivery efficiency is improved by more than 60%; four first through holes 342 and four third through holes 344 on the ventilating ring pipe 341 and four second through holes 327 on the water delivery main pipe 32 are symmetrically arranged at intervals, each third through hole 344 is connected to an air supply main pipe 345 through a corresponding air supply branch pipe 343, and the air supply main pipe 345 is connected to the air source namely an air compressor, thereby uniformly mixing the air into the ventilating ring pipe 341 and the water delivery main pipe 32 in multiple paths and multiple points through the air supply branch pipes 343, as shown in FIG. 8, FIG. 10, and FIG. 11.

Figure 12:
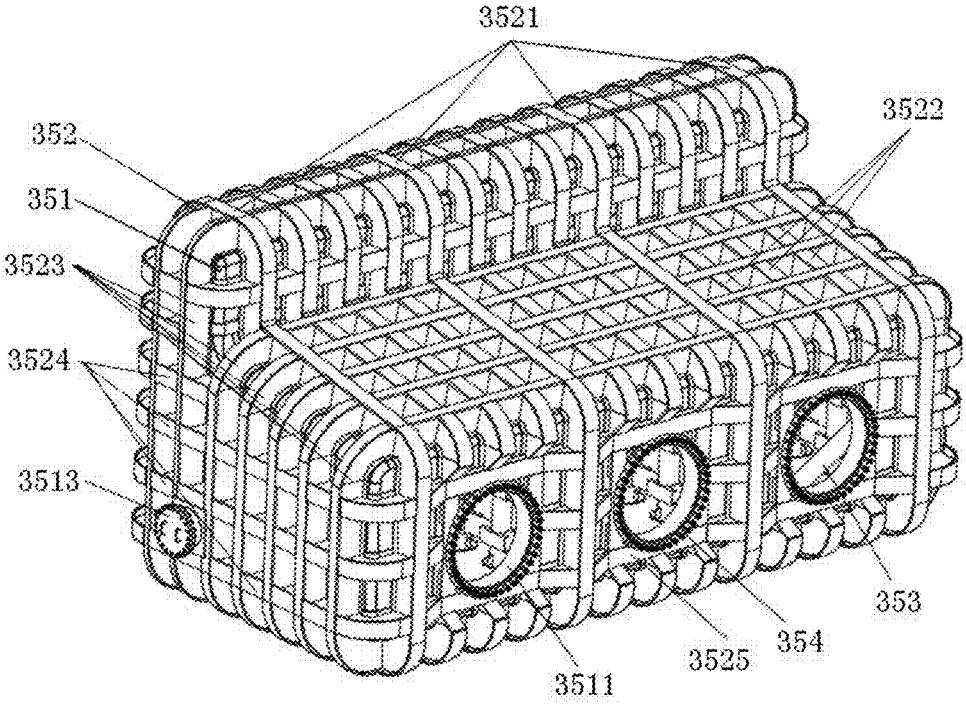
FIG. 12 is an axial side view of a front surface of a pressure-stabilizing and vibration-reducing box.
Figure 13:
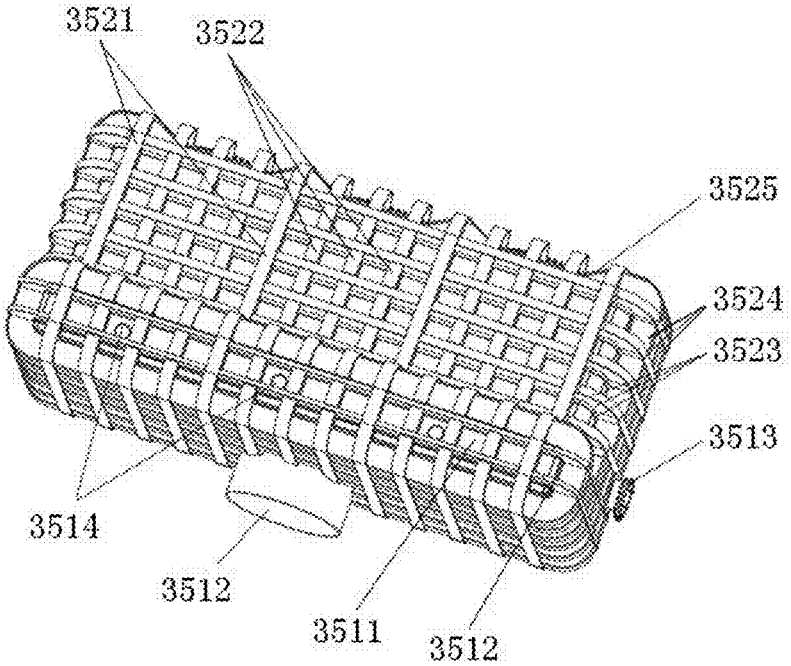
FIG. 13 is an axial side view of a top surface of the pressure-stabilizing and vibration-reducing box.
Figure 14:
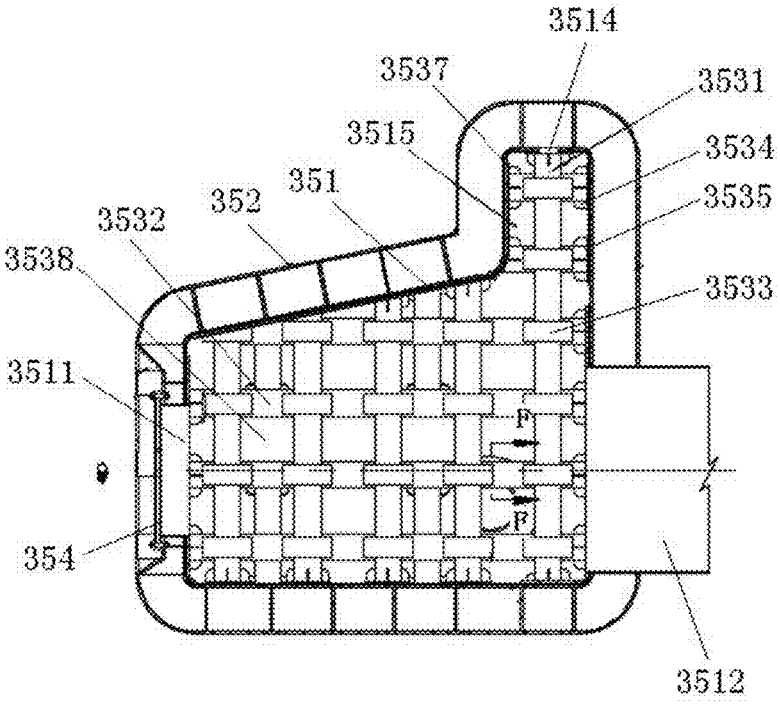
FIG. 14 is a cross-section structure diagram of the pressure-stabilizing and vibration-reducing box.
Figure 15:
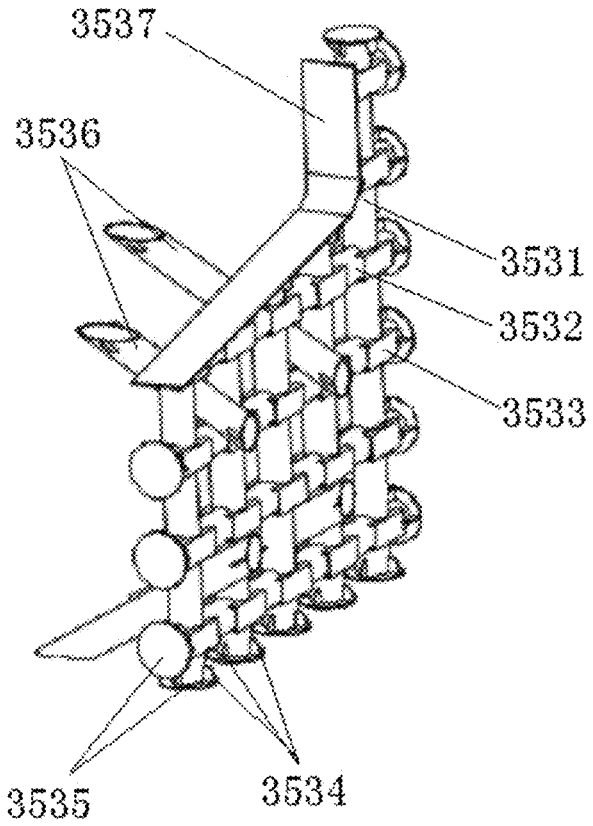
FIG. 15 is a schematic diagram of an inner beam system fence in the pressure-stabilizing and vibration-reducing box.
Figure 16:
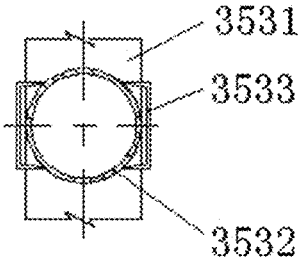
FIG. 16 is an F-F view of FIG. 14.
Figure 17:
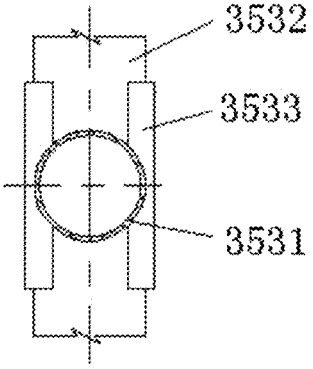
FIG. 17 is a top view of FIG. 16.

Each pressure-stabilizing and vibration-reducing box 35 comprises a housing 351 and an outer beam system 352, a cavity is formed in the housing 351, water inlets 3533 and a water outlet 3512 are formed in the housing 351, the outer beam system 352 is arranged on the outer wall of the housing 351, and inner beam system fences 353 are arranged in the cavity of the housing 351 at intervals; each inner beam system fence 353 comprises a hollow plate formed by crisscrossed vertical rods 3531 and horizontal rods 3532 to match the shape of the cross section of the cavity of the housing 351, and tension diagonals 3536 are arranged in hollowed parts of the hollow plate to reduce disturbance of the inner beam system fence to the water flow to the greatest extent while meeting high-intensity requirements; the crisscrossed vertical rods 3531 and horizontal rods 3532, and the tension diagonals 3536 in the pressure-stabilizing and vibration-reducing box 35 are hollow round tubes, and groove-shaped reinforcing plates 3533 are arranged at crisscrossed parts of the vertical rods 3531 and the horizontal rods 3532; cushion plates 3535 are arranged at connection parts between the inner beam system fences 353 and the side walls of the cavity of the housing 351 and connection parts between the inner beam system fences 353 and the bottom walls of the cavity of the housing 351, as shown in FIG. 16 and FIG. 17; furthermore, reinforcing ribs 3534 are arranged between the cushion plates 3535 and the vertical rods 3531 and between the cushion plates 3535 and the horizontal rods 3532, and filler strips 3537 are arranged at connection parts between the inner beam system fences 353 and the top wall of the cavity of the housing 351, as shown in FIG. 15, thereby facilitating connection with the walls of the cavity of the housing, reducing disturbance to the water flow, and meeting hydrodynamic requirements; a manhole 3513 for overhauling is formed in the housing 351 of the pressure-stabilizing and vibration-reducing box 35, a gas collection groove 3515 is arranged at the back part of the interior of the housing 351, exhaust holes 3514 are formed in the top of the gas collection groove 3515, and the exhaust holes 3514 are connected to an exhaust pipe, as shown in FIG. 13 and FIG. 14; the outer beam system 352 of the pressure-stabilizing and vibration-reducing box 35 coats the whole outer wall of the housing 351, the outer beam system 352 comprises four main cross beam plates 3521, a plurality of secondary cross beam plates 3522, a plurality of vertical beam plates 3523 and a plurality of horizontal beam plates 3524, the main cross beam plates 3521 have the same height and are arranged at intervals, the secondary cross beam plates 3522 are located between each pair of the main cross beam plates 3521 and are shorter than the main cross beam plates 3521, the vertical beam plates 3523 are vertical to the main cross beam plates 3521 and the secondary cross beam plates 3522, have the same height and are arranged at intervals, the horizontal beam plates 3524 have the same width and length and are arranged at intervals, and all the beam plates are in mutually interlacing connection to form the outer beam system 352; a sunken variable-cross-section beam plate set 3525 is arranged on a part, located at a water inlet 3511, of the outer beam system, and the outer side of the variable-cross-section beam plate set 3525 is level with the end face of a flange 354, as shown in FIG. 12; three water inlets 3511 and one water outlet 3512 are formed in the pressure-stabilizing and vibration-reducing box 35 and are respectively located on the front side and the back side of the housing 351, as shown in FIG. 12 and FIG. 13; and the three water inlets 3511 of the pressure-stabilizing and vibration-reducing box 35 are connected to the water delivery main pipe 32 through the water delivery valves 33 and the water delivery pipes, wherein the water delivery valve on the water inlet at the middle part is a main valve, the water delivery valves on the water inlets on the two sides are auxiliary valves, and the circular forced ventilating mechanisms 34 are respectively arranged at parts, located at the front of one main valve and two auxiliary valves, of the water delivery main pipe 32, so that the auxiliary valves with relatively smaller flow rate of delivered water and relatively better cavitation resistance control the ship reception chamber to operate at the low speed (during butt joint), and the main valve with relatively larger flow rate of the delivered water increases the operating speed of the ship reception chamber at the normal lifting stage, resulting in elimination of influence of non-constant flow generated by the stabilizing and equalizing hydraulic driving system to the stability of the operating speed of the ship reception chamber.

The hydraulic ship lift with anti-overturning capability, provided by the present disclosure, fulfills the following principles and methods.

Figure 5:
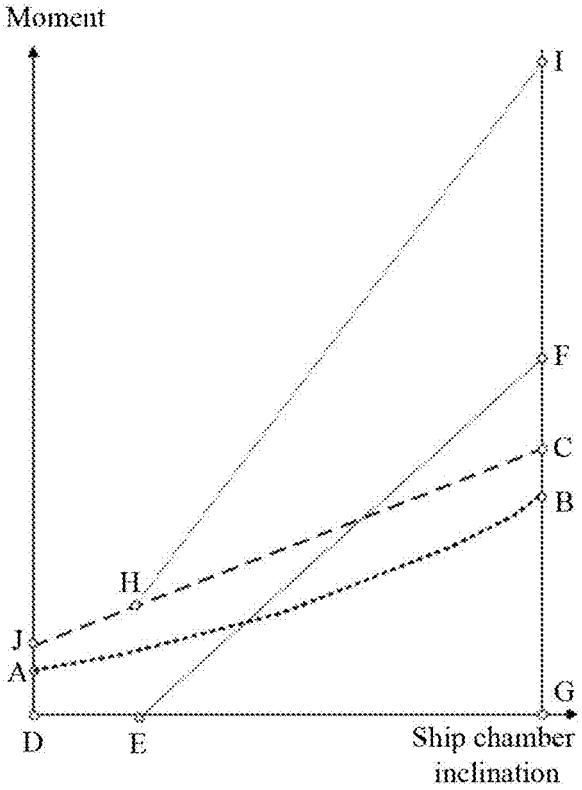
FIG. 5 is a moment curve diagram of a stabilizing and equalizing hydraulic driving system, a mechanical synchronizing system and a self-feedback stabilizing system under the combined action.

For the mechanical synchronizing system, the stabilizing and equalizing hydraulic driving system and the self-feedback stabilizing system, which form the hydraulic ship lift with anti-overturning capability of the present disclosure, their combined anti-overturning capability comprises the following three stages:

(1) at the first stage, a tilt of a ship reception chamber is $\theta \leq \Delta < \theta R$;

at this stage, the clearance of the mechanical synchronizing system is not eliminated, so the mechanical synchronizing system does not fully exert the anti-overturning capability, the self-feedback stabilizing system bears initial overturning moment of the ship reception chamber to maintain the ship reception chamber stable, and at this stage, anti-overturning moment provided by the self-feedback stabilizing system fulfills the following formula:

$$K_d \times \Delta + M_{d0} = M_d > \gamma_d \times (M_c + M_w) = \gamma_d \times (K_c \times \Delta + M_w)$$

overall anti-overturning rigidity of the self-feedback stabilizing system fulfills the following formula:

$$K_d > \gamma_d \times \left( K_c + \frac{M_w - M_{d0}/\gamma_d}{\Delta} \right)$$

in the formulas:

overturning moment generated by a tilted ship reception chamber is $Mc = Kc \times \Delta$, and its unit is kN·m;

overturning rigidity of the ship reception chamber is $K_c$ and its unit is kN;

a total tilt of the ship reception chamber is $\Delta$ and its unit is m;

initial overturning moment of the ship reception chamber generated by the stabilizing and equalizing hydraulic driving system is $M_w$ and its unit is kN·m;

a total overturning moment of the ship reception chamber is $M_c + M_w = K_c \times \Delta + M_w$ and its unit is kN·m;

anti-overturning moment generated by the self-feedback stabilizing system is $M_d = K_d \times \Delta + M_{d0}$ and its unit is kN·m;

pre-loading anti-overturning moment of the self-feedback stabilizing system is $M_{d0}$ and its unit is kN·m;

overall anti-overturning rigidity of the self-feedback stabilizing system is $K_d$ and its unit is kN;

a safety coefficient $\gamma_d$ of the self-feedback stabilizing system is 1.5-2.0;

the stabilizing and equalizing hydraulic driving system eliminates unbalanced loads of the ship reception chamber and disturbance of the water body in the ship reception chamber by reducing vertical shaft water level difference and operating speed fluctuation of the ship reception chamber so as to reduce the value of the initial overturning moment of the ship reception chamber $M_w$, and in FIG. 5, it is expressed to reduce the value of initial disturbance overturning moment A of an AB overturning moment curve of the ship reception chamber; and pre-loads of the self-feedback stabilizing system decide the value of $M_{d0}$, and the anti-overturning rigidity $K_d$ decides the value of the anti-overturning moment resisting the ship reception chamber;

(2) at the second stage, the tilt of the ship reception chamber is $\theta R \leq \Delta < \Delta_{max}$;

this stage is from a moment that the clearance of the mechanical synchronizing system is eliminated to a moment that the tilt of the ship reception chamber is smaller than a designed allowable limit tilt value $\Delta_{max}$; at this stage, the self-feedback stabilizing system and the synchronizing shafts of the mechanical synchronizing system jointly bear an anti-overturning capability to the ship reception chamber, wherein the synchronizing shafts of the mechanical synchronizing system exert the main anti-overturning capability, and a proportion of the anti-overturning capability achieved by both of the self-feedback stabilizing system and the mechanical synchronizing system is related to the rigidity $K_d$ and $K_t$ of the self-feedback stabilizing system and the mechanical synchronizing system; total anti-overturning moments of the self-feedback stabilizing system and the mechanical synchronizing system fulfills the following formula:

$$K_d \times \Delta + M_{d0} + K_T \times (\Delta - \theta R) = M_d + M_T > (\gamma_d + \gamma_T) \times (M_c + M_w) = (\gamma_d + \gamma_T) \times (K_c \times \Delta + M_w)$$

overall anti-overturning rigidity of the mechanical synchronizing system fulfills the following formula:

$$K_T > \frac{(\gamma_d + \gamma_T) \times (K_c \times \Delta + M_w) - K_d \times \Delta - M_{d0}}{(\Delta - \theta R)}$$

in the formulas:

anti-overturning moment generated by the synchronizing shafts of the mechanical synchronizing system is $M_T = K_T \times (\Delta - \theta R)$ and its unit is kN·m;

clearance of the mechanical synchronizing system is θ and its unit is radian;

radius of each drum is R and its unit is m;

overall anti-overturning rigidity of the mechanical synchronizing system is $K_T$ and its unit is kN;

a safety coefficient $\gamma_T$ of the mechanical synchronizing system is 6-7;

the clearance θR of the mechanical synchronizing system decides a position, at which the mechanical synchronizing system starts exerting the anti-overturning capability, and in FIG. 5, it is expressed to be the value of an E value; the overall anti-overturning rigidity $K_T$ of the mechanical synchronizing system decides the value of the anti-overturning moment of the ship reception chamber, and in FIG. 5, it is expressed to be slope of an EF anti-overturning moment curve; and the larger the overall anti-overturning rigidity $K_T$ is, the larger the slope is, and the stronger the system anti-overturning capability is;

at the third stage, the tilt of the ship reception chamber is $\Delta \geq \Delta_{max}$;

when the tilt of the ship reception chamber exceeds a designed allowable maximum tilt value $\Delta_{max}$, the self-feedback stabilizing system exerts a tilt of a ship reception chamber limiting function; continuously increased overturning moment of the ship reception chamber is exerted on the mechanical synchronizing system; at this stage, the stabilizing and equalizing hydraulic driving system is closed, the ship reception chamber of the ship lift stops operating, safety devices on the drums of the mechanical synchronizing system start to operate, the continuously increased overturning moment of the ship reception chamber is born by the safety devices on the drums; and drum braking force fulfills the following formula:

$$F_z \geq \gamma_z \times F_c$$

in the formula:

total drum braking force is $F_z$ and its unit is kN;

total weight of the water body in the ship reception chamber is $F_c$ and its unit is kN; and a safety coefficient of the drum braking force is $\gamma_z$ of 0.4-1.0.

The mechanical synchronizing system fulfills the following principles and methods:

in the mechanical synchronizing system of the present disclosure, the two rows of drums, the couplings, the synchronizing shafts, the bevel gear pairs, the couplings and the horizontal synchronizing shafts are completely symmetric, the ship reception chamber is fully leveled, stress and friction of each drum and each wire rope are totally the same, and rigidity influence from the ship reception chamber and the wire ropes are ignored, so that the rigidity and the intensity of the mechanical synchronizing system fulfill the following principles and methods, which are specifically as follows:

I. Rigidity Setting Method maximum tilt load ΔP acting on the mechanical synchronizing system by the tilted ship reception chamber is calculated according to the following formula:

$$\Delta P = \frac{(\Delta h + \Delta h_0) L_c B_c \rho g}{24} + \frac{M_b + M_p}{2L_c} \quad (1)$$

in the formula:

Δh is a tilt of a ship reception chamber caused by deformation of the synchronizing shafts under unbalanced loads and clearance sum of the synchronizing shafts, and its unit is m;

$\Delta h_0$ is a tilt of a ship reception chamber caused by machining and mounting errors of the drums, wire ropes and the like when the ship reception chamber lifts up and down, and its unit is m;

$L_c$ is length of the ship reception chamber and its unit is m;

$B_c$ is width of the ship reception chamber and its unit is m;

ρ is density and its unit is $kg/m^3$;

g is gravitational acceleration and its unit is $m/s^2$;

$M_b$ is overturning moment caused by water surface fluctuation of the ship reception chamber and its unit is kN·m;

$M_p$ is overturning moment caused by eccentric loads of the ship reception chamber and its unit is kN·m;

when the tilt $\Delta_h$ of the ship reception chamber is caused by the deformation of the synchronizing shafts under unbalanced loads and the clearance sum of the synchronizing shafts, anti-overturning force ΔF, which is acting on the ship reception chamber through the drums, of the mechanical synchronizing system is calculated according to the following formula:

$$\Delta F = \frac{\Delta h - \theta_2 R + 4M_f R\sum_{i=1}^{n}\frac{L_i}{GI_{pi}}}{R^2\sum_{i=1}^{n}\frac{L_i}{GI_{pi}}} \tag{2}$$

in the formula:

ΔF is anti-overturning force acting on the ship reception chamber and its unit is kN;

Δh is the tilt of the ship reception chamber caused by deformation of the synchronizing shafts under unbalanced loads and clearance sum of the synchronizing shafts, and its unit is m;

$\theta_2$ is total clearance among the synchronizing shafts and its unit is radian;

R is radius of the drum and its unit is m;

$M_f$ is torque generated by friction force of a single drum and its unit is kN·m;

G is shearing modulus of elasticity and its unit is kPa;

$L_i$ is length of the i-th synchronizing shaft and its unit is m;

$I_{pi}$ is polar moment of inertia of the section of the i-th synchronizing shaft, wherein:

$$I_p = \frac{\pi D^4}{32}(1 - a^4)$$

in the formula:

D is outer diameter of the synchronizing shaft;

a is inner diameter/outer diameter of a hollow synchronizing shaft; if it is a solid synchronizing shaft, the inner diameter is equal to 0, namely a=0;

therefore, in the absence of the intensity loss of the synchronizing shaft, it can be seen that:

(1) ΔF>ΔP, a tilt Δh of a ship reception chamber is reduced when the deformation of the synchronizing shafts under unbalanced loads and the clearance sum of the synchronizing shafts cause the ship reception chamber to incline by Δh, and anti-overturning force ΔF acting on the ship reception chamber by the drums is larger than maximum tilt load ΔP acting on the mechanical synchronizing system by the tilted ship reception chamber;

(2) ΔF<ΔP, when the tilt Δh of the ship reception chamber is continuously increased, the synchronizing shafts need to generate larger torsional deformation and generate larger resistance force, so that the balance of the ship reception chamber can be ensured;

(3) ΔF=ΔP, when the tilt Δh of the ship reception chamber is equal to the maximum tilt load ΔP acting on the mechanical synchronizing system by the tilted ship reception chamber, the ship reception chamber is stable, so:

$$\beta = \frac{L_c B_c \rho g}{24},\ \delta = R\sum_{i=1}^{n}\frac{L_i}{GI_{pi}}$$

according to the condition that the ship reception chamber is stable, namely ΔF=ΔP, it can be seen that the following conditions that the ship reception chamber is stable are fulfilled:

$$\Delta h = \frac{\theta_2 R}{1-\beta\delta R} + \frac{\Delta h_0 \beta\delta R}{1-\beta\delta R} + \frac{\delta R(M_b + M_p)}{2L_c(1-\beta\delta R)} - \frac{4\delta M_f}{1-\beta\delta R} \tag{3}$$

due to Δh≥0, the total rigidity of the mechanical synchronizing system is defined as $$K = \frac{1}{\sum_{i=1}^{n}\frac{L_i}{GI_{pi}}},$$

and an essential condition which makes the formula (4) workable is 1>βδ, that is, an essential condition, under which the mechanical synchronizing system can keep the ship reception chamber stable, is:

$$K > \frac{L_c B_c \rho g R^2}{24} \tag{4}$$

when the ship reception chamber lifts up and down, the allowable maximum tilt of a ship reception chamber is $\Delta h_{max}$, so that the rigidity of the mechanical synchronizing system further fulfills:

$$\gamma_1(\theta_2 R + \Delta h_0) + \gamma_2(M_h + M_p) - \gamma_3 M_f \leq \Delta h_{max} \tag{5}$$

in formula:

(1) $\gamma_1(\theta_2 R + \Delta h_0)$ is tilt generated by manufacturing errors, namely a tilt of a ship reception chamber caused by the clearance of the mechanical synchronizing system, wire rope errors and the like, wherein $$\gamma_1 = \frac{1}{1-\beta\delta R}$$

is defined as manufacturing error tilt coefficient, $g_1$ is defined as coefficient related to the dimension of the ship reception chamber and the rigidity of the synchronizing shaft, γ1∈[1,+∞), can be seen by combining with the formula (5), and γ1 is a numerical value larger than or equal to 1 according to the definition of the coefficient γ1; the larger the rigidity of the synchronizing shaft is, the smaller the value of γ1 is, but the value of γ1 is not smaller than 1; and when the rigidity of the synchronizing shaft is infinitely large, γ1=1, and at this point, the maximum a tilt of a ship reception chamber caused by the manufacturing errors is $\theta_2 R + \Delta h_0$; therefore, γ1 exerts an enlarging function to the tilt of the ship reception chamber caused by the manufacturing errors, wherein the smaller the rigidity of the synchronizing shaft is, the larger the enlarging function to the tilt of the ship reception chamber caused by the manufacturing errors is; and the larger the rigidity of the synchronizing shaft is, the smaller the enlarging function to the tilt of the ship reception chamber caused by the manufacturing errors is;

(2) $\gamma_2(M_b+M_p)$ is a tilt $\Delta H_2$ of a ship reception chamber caused by the overturning moment, namely a tilt of a ship reception chamber generated under the action of overturning moment caused by water surface fluctuation, ship reception chamber eccentric loads and the like, wherein $$\gamma_2 = \frac{\delta R}{2L(1-\beta\delta R)}$$

is defined as fluctuation tilt coefficient, $\gamma_2 \rightarrow 0$ when the rigidity is infinitely large, and at this point, influence on the tilt of the ship reception chamber due to the overturning moment caused by the water surface fluctuation is smaller;

(3) $-\gamma_3 M_f$ is resistance, generated by system friction force, to the tilt of the ship reception chamber, wherein $$\gamma_3 = \frac{4\delta}{1-\beta\delta R}$$

is defined as friction force tilt resistance coefficient, and the larger the system friction force is, the more the reduction of the tilt of the ship reception chamber is helpful;

therefore, the mechanical synchronizing system has the anti-overturning capability, and the rigidity of the synchronizing shafts of the mechanical synchronizing system simultaneously fulfills formula (4) and formula (5);

II Intensity Setting Method maximum torque of the synchronizing shaft $T_N$ during operation of the ship reception chamber is expressed to be:

$$T_N=\varphi_1[M_Q+2L\beta(\theta_2R+\Delta h_0)]-\varphi_3M_f+M_k+M_g=\varphi_1M_Q+\varphi_2(\theta_2R+\Delta h_0)-\varphi_3M_f+M_k+M_g$$

in formula:

φ1 is overturning moment coefficient;

$M_Q$ is an overturning moment of a ship reception chamber and its unit is kN·m;

$\varphi_2$ is manufacturing error coefficient;

$\theta_2R+\Delta h_0$ is manufacturing errors of the mechanical synchronizing system;

$\varphi_1M_Q$ represents influence on the torque of the synchronizing shaft due to an overturning moment of a ship reception chamber $M_Q$ generated by water surface fluctuation of the ship reception chamber, eccentric loads of the ship reception chamber and the like;

$\varphi_2(\theta_2R+\Delta h_0)$ represents influence on the torque of the synchronizing shaft due to the manufacturing errors $\theta_2R+\Delta H_0$ of the mechanical synchronizing system after water is loaded to the ship reception chamber;

$\varphi_1M_Q+\varphi_2(\theta_2R+\Delta h_0)$ represents influence on the torque of the synchronizing shaft loads due to the water body in the ship reception chamber;

$-\varphi_3M_f$ reflects resistance of system friction force to the torque of the synchronizing shaft;

$M_k$ reflects internal torque change of the synchronizing shaft generated by the mounting errors and the like when the synchronizing shafts rotate;

$M_g$ reflects initial torque generated to the synchronizing shafts due to unbalance stress of adjacent drums and wire ropes when the ship reception chamber is initially leveled;

when the ship reception chamber without water lifts up and down, influence of both $\varphi_1M_Q+\varphi_2(\theta_2R+\Delta h_0)$ can be ignored, so, when the ship reception chamber without water lifts up and down, the torque of the synchronizing shaft can be expressed to be:

$$T_N=-\varphi_3M_f+M_k+M_g$$

III Clearance and Manufacturing Error Control Conditions

Clearance $\theta_2R$ and manufacturing error tilt $\Delta h_0$ of the mechanical synchronizing system are controlled according to the following conditions:

$$(\theta_2R+\Delta h_0) \le \frac{\Delta h_{max}+\gamma_3M_f-\gamma_2(M_b+M_p)}{\gamma_1} \quad (6)$$

$$(\theta_2R+\Delta h_0) \le \frac{(M_{max}-M_k-M_g)+\varphi_3M_f-\varphi_1M_Q}{2L\beta\varphi_1} \quad (7)$$

in the formulas:

$\Delta h_{max}$ is allowable maximum tilt of a ship reception chamber and its unit is m;

$M_{max}$ is allowable maximum torque of the mechanical synchronizing system and its unit is kN·m; and the meanings of the residual signs are ditto.

Other settings of the mechanical synchronizing system are carried out by routine.

Figure 23:
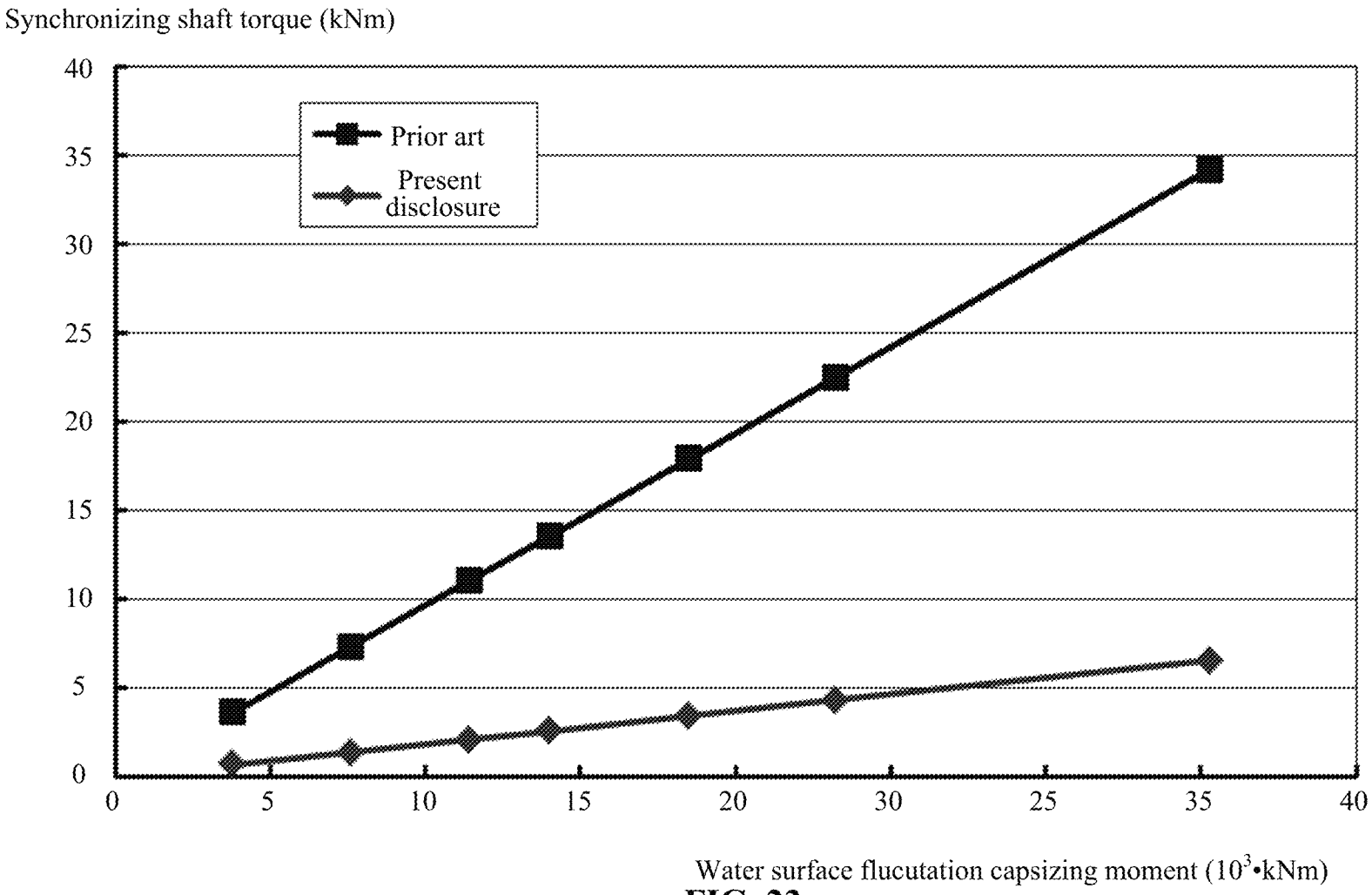
FIG. 23 is a comparison diagram of influence on tilt when the water surface of the ship reception chamber fluctuates in the prior art and the present disclosure.
Figure 24:
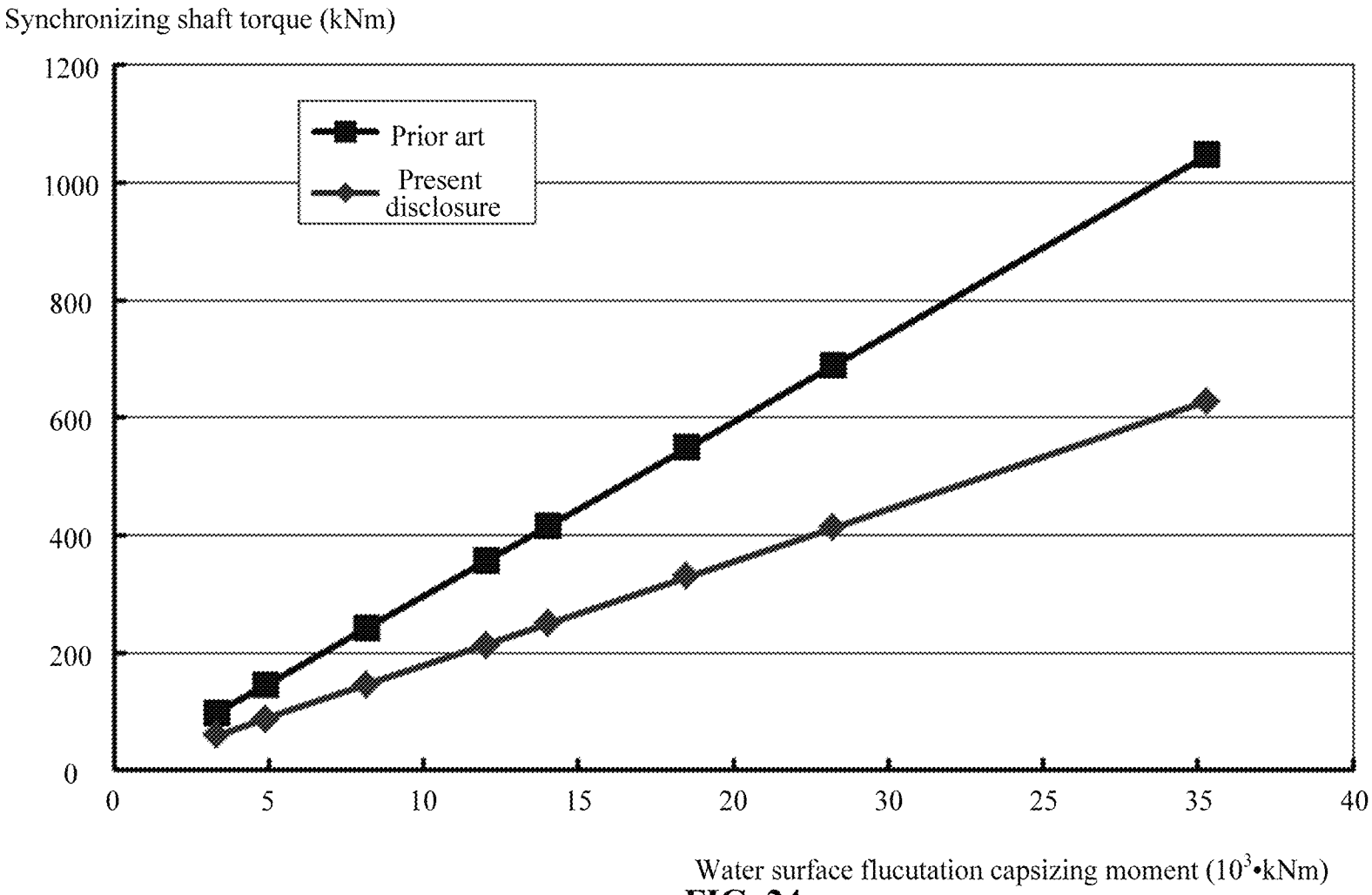
FIG. 24 is a comparison diagram of influence on synchronizing shaft torque when the water surface of the ship reception chamber fluctuates in the prior art and the present disclosure.

Comparing the foregoing settings with the prior art, it can be seen that: the tilt of the ship reception chamber of the ship lift of the present disclosure is further smaller than the tilt of the ship reception chamber of the ship lift in the prior art; when the tilt moment of water surface fluctuation is $20*10^3$ kN·m, the ship reception chamber generates tilt of about 15.6 cm based on actual measurement in the prior art, but the ship reception chamber only generates tilt of 3.0 cm in the present disclosure, as shown in FIG. 23; furthermore, after the mechanical synchronizing system with anti-overturning capability is arranged in the present disclosure, the maximum torque generated by the water surface fluctuation of the ship reception chamber may also be remarkably reduced; and when the overturning moment of the water surface fluctuation is $20*10^3$ kN·m, the maximum torque of the synchronizing shaft in the prior art is 554 kN·m, but the maximum torque of the synchronizing shaft in the present disclosure is 338.6 kN·m, as shown in FIG. 24.

In a ship reception chamber dynamic operation test of 1:10, the mechanical synchronizing system with anti-overturning capability of the present disclosure can ensure that the hydraulic ship lift is a convergent and stable system, the tilt of the ship reception chamber and ship reception chamber water surface fluctuation are not increased and diverged, and in a lifting operation procedure of the ship reception chamber with water, the longitudinal tilt of the ship reception chamber is only increased by 3.5 cm, the maximum torque of the synchronizing shaft change amplitude is 192.6 kN·m, and the ship reception chamber does not generate a stabilization failure condition in the whole operation procedure.

The water delivery main pipe and the plurality of branch water pipes of the stabilizing and equalizing hydraulic driving system fulfill the following principles and methods:

the water delivery main pipe and the branch water pipes incorporate the requirement that water flow inertia length is completely the same, specifically, length and section dimension of a pipe segment from a water delivery main pipe entrance to a corresponding vertical shaft (exit) are completely equal to total length and total section dimension of a corresponding branch water pipe, so as to meet equal inertia setting requirements.

Maximum flow rate of the branch water pipes is smaller than 6 m/s, so, the first resistance equalizing members 36 and the second resistance equalizing members 37 are respectively arranged at the corners of the angle pipes and the bifurcated pipes in order to ensure that the flow rate of each branch water pipe in the narrow and vertical space is the same, and furthest ensure that the flow rate of each branch water pipe into the corresponding vertical shaft is the same and meets equal resistance setting requirements.

The communicated water level equalizing gallery 326 is arranged at the bottom of each vertical shaft 31 and minimum cross section area of the water level equalizing gallery 326 is calculated by the following method:

$$\omega = K\frac{2C\sqrt{H}}{\mu T\sqrt{2g}} \tag{8}$$

in the formula:

ω is area of the water level equalizing gallery and its unit is $m^2$;

C is area of adjacent vertical shafts and its unit is $m^2$;

H is allowable maximum water level difference of adjacent vertical shafts, and its unit is m;

μ is flow rate coefficient of the water level equalizing gallery;

T is maximum water level difference allowable lasting time and its unit is s;

K is safety coefficient of 1.5-2.0; and g is gravitational acceleration and its unit is $m/s^{-2}$.

Based on calculation of formula (8), the area of the water level equalizing gallery 326 is set larger than 7 $m^2$; the water level difference among the vertical shafts 31 is set smaller than 0.6 m, the water level difference lasting time is smaller than 5 s, thereby avoiding accumulation of the water level difference among the vertical shafts 31.

Other settings of the stabilizing and equalizing hydraulic driving system are carried out by routine.

Figure 25:
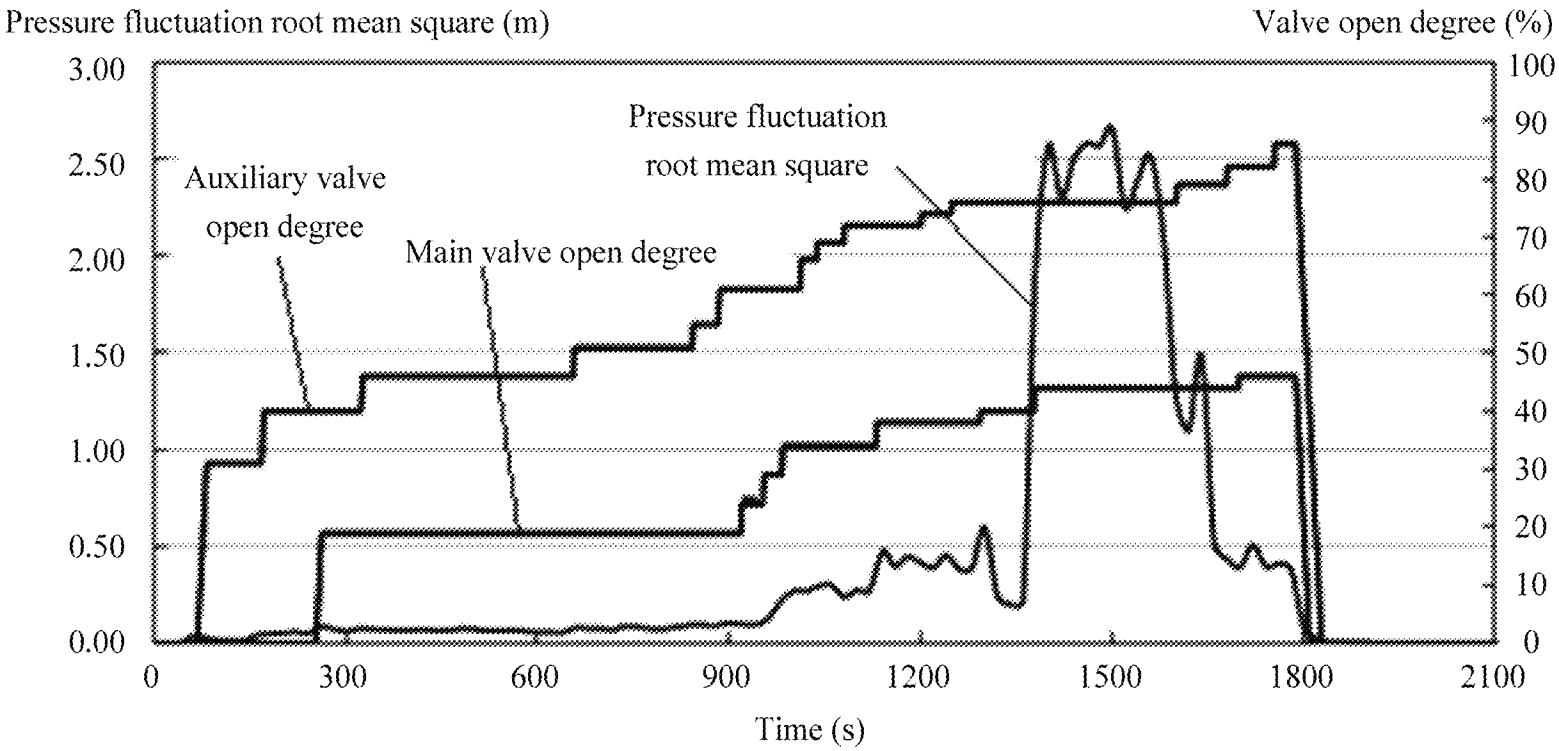
FIG. 25 is a diagram of pressure fluctuation root mean square of measurement points at the back of water delivery valves with the same open degree in the prior art.
Figure 26:
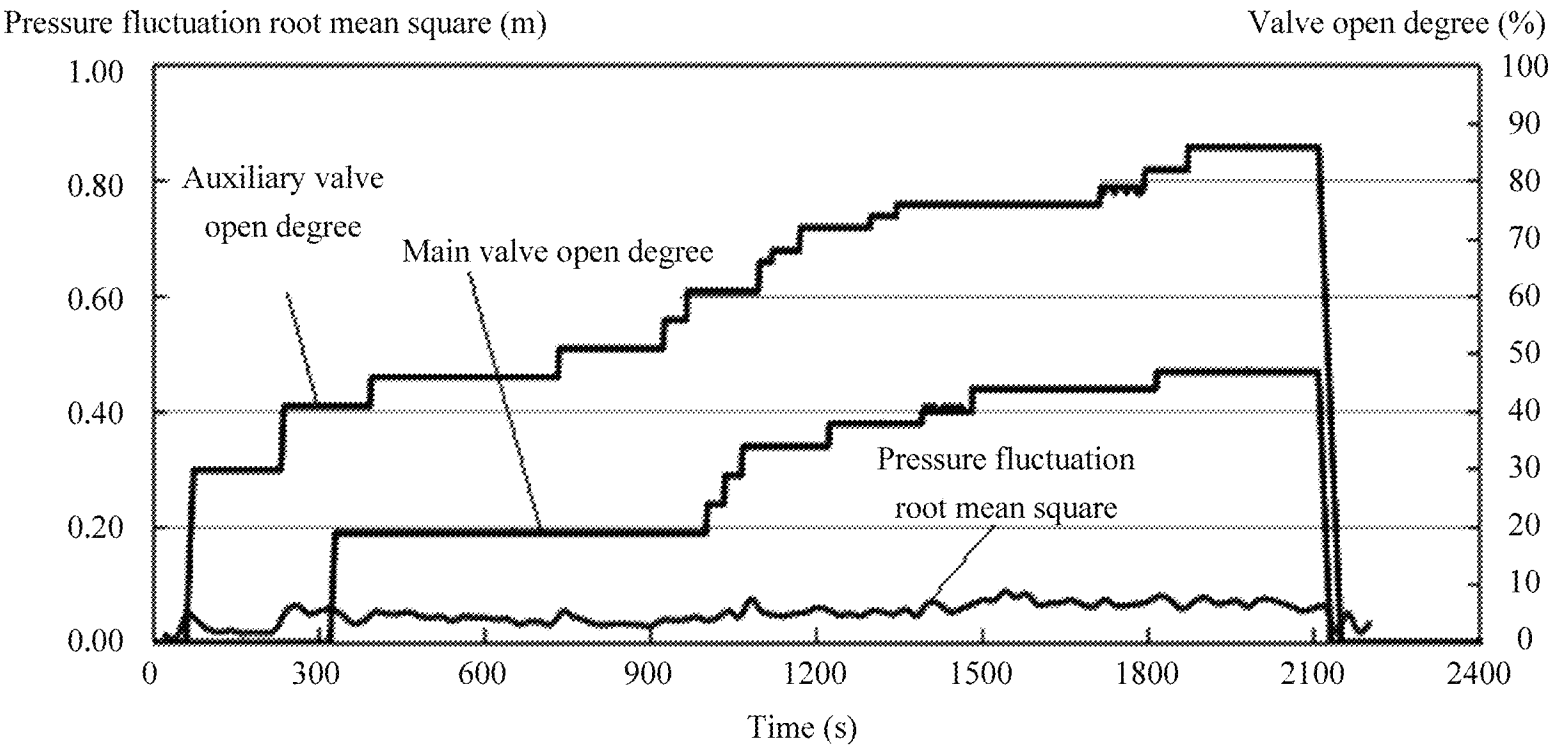
FIG. 26 is a diagram of pressure fluctuation root mean square of measurement points at the back of water delivery valves with the same open degree in the present disclosure.
Figure 27:
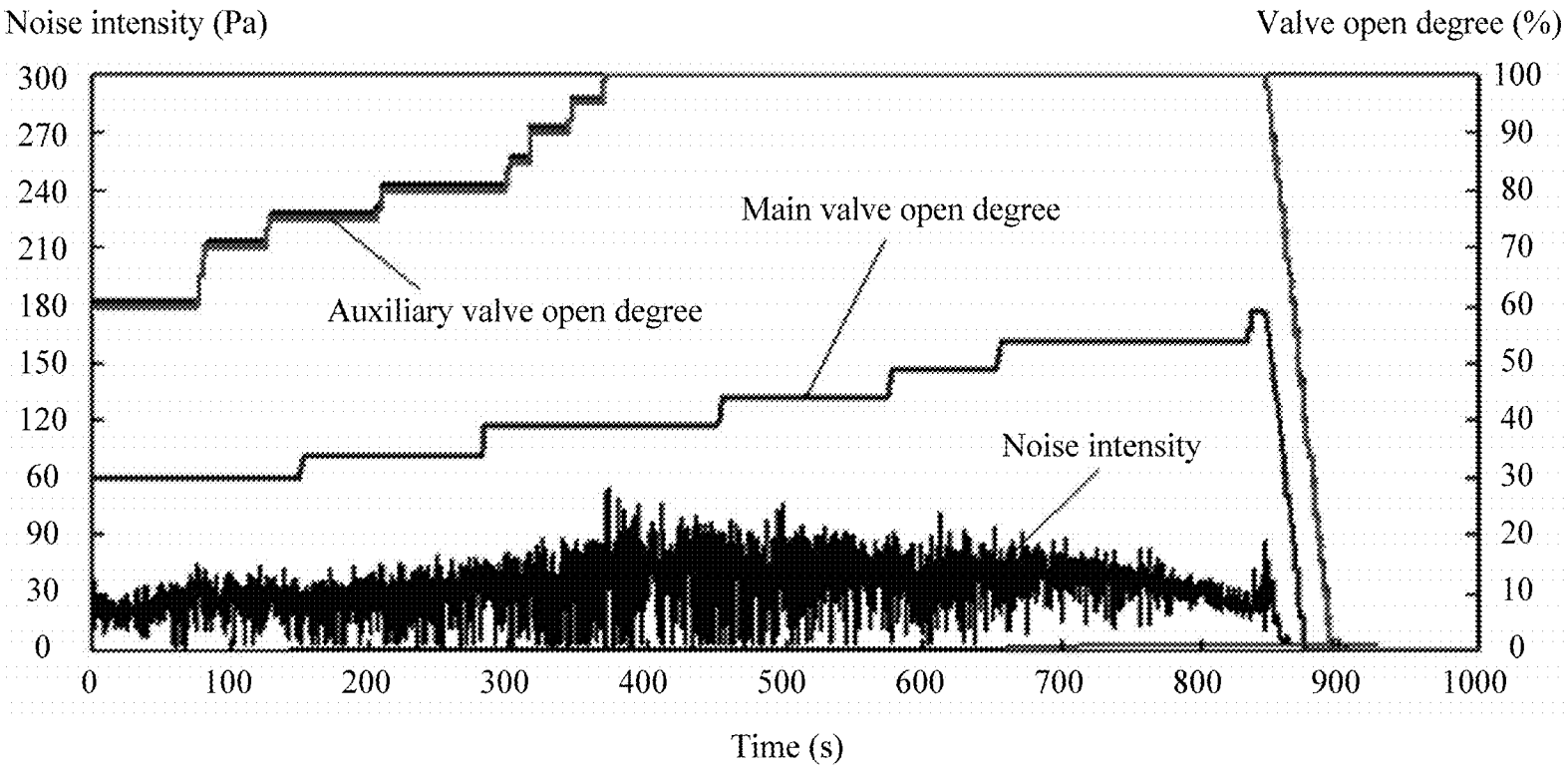
FIG. 27 is a diagram of noise intensity when the water delivery valves have the same open degree in the prior art.
Figure 28:
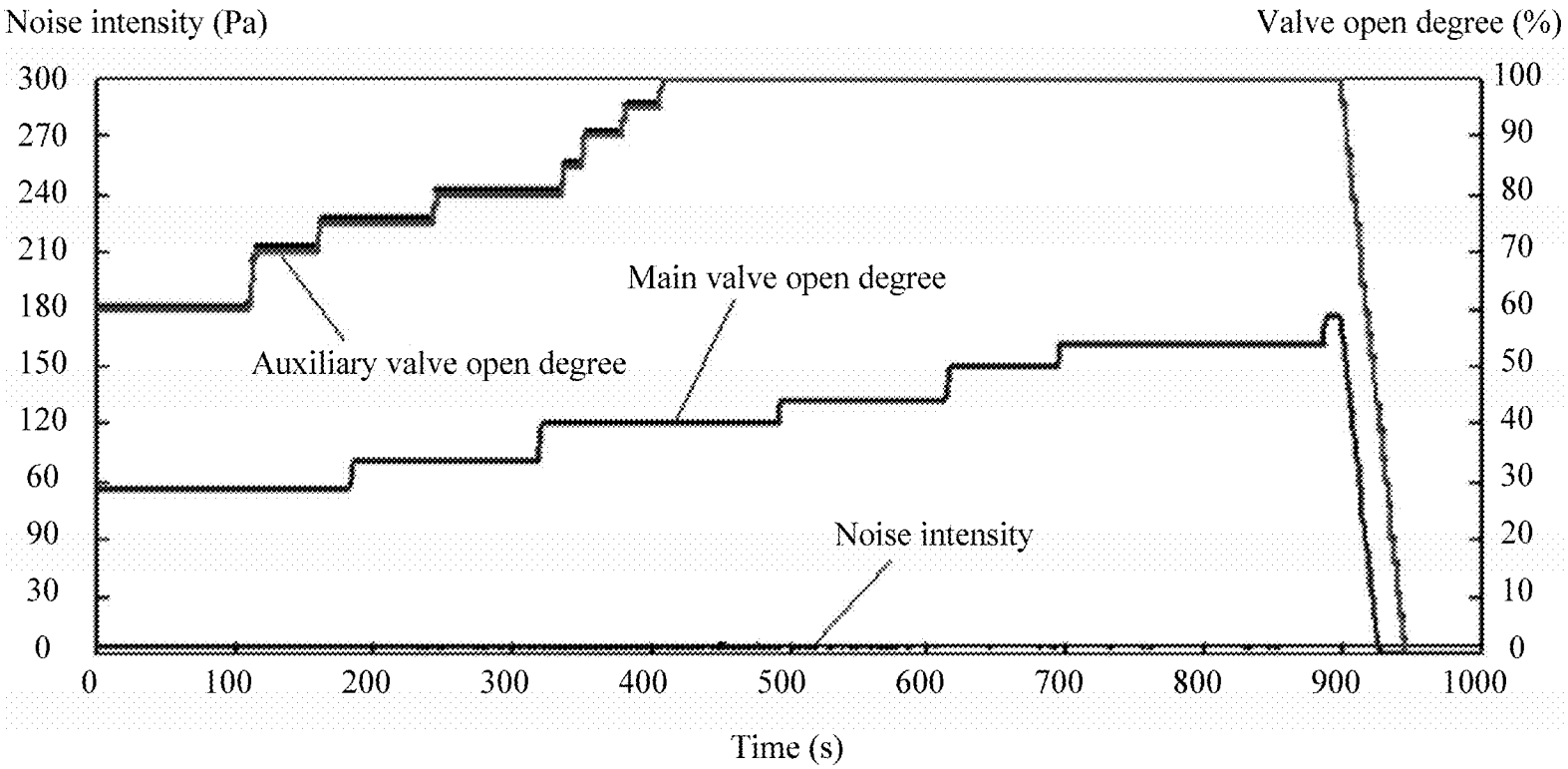
FIG. 28 is a diagram of noise intensity when the water delivery valves have the same open degree in the present disclosure.
Figure 29:
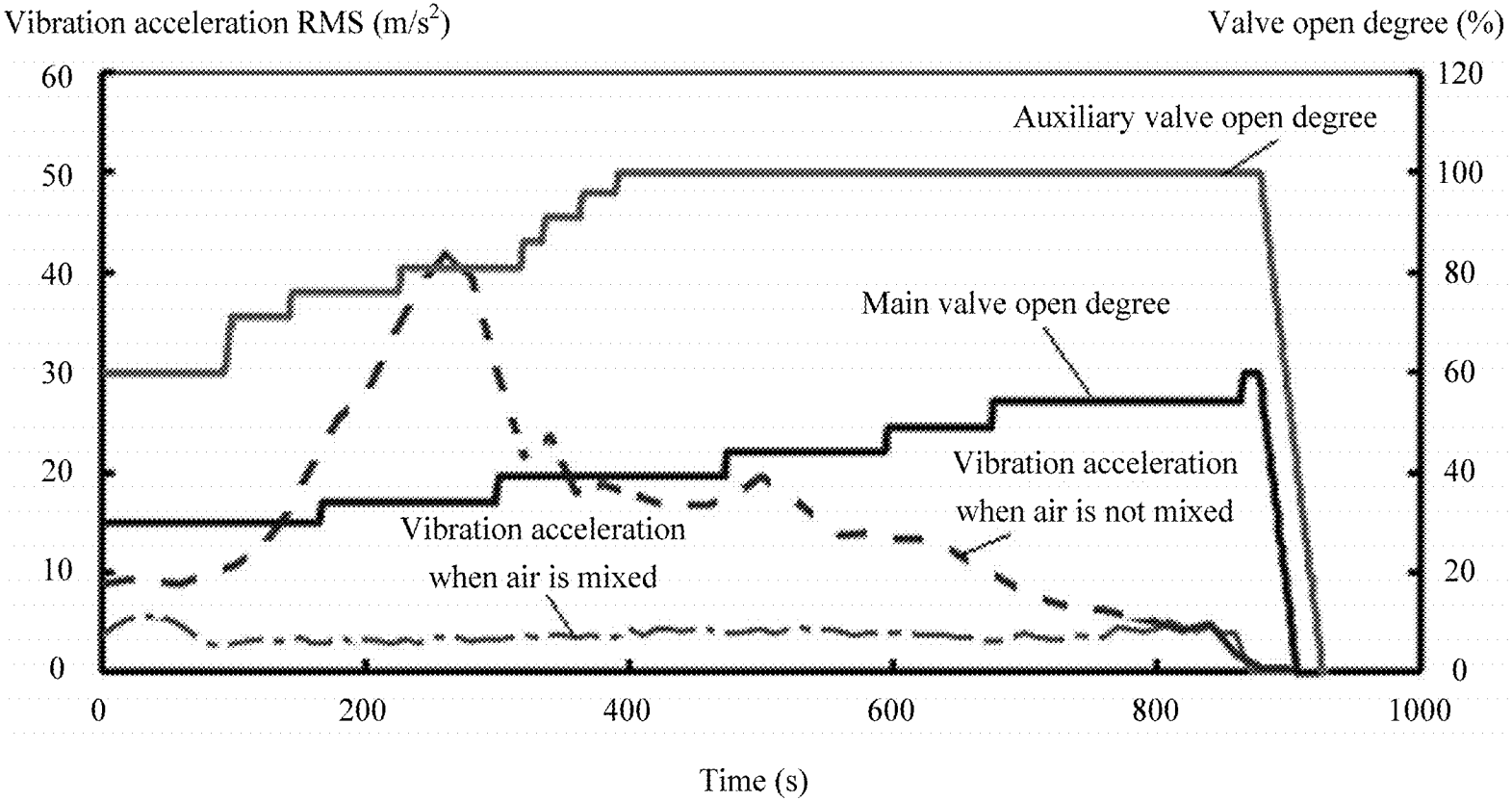
FIG. 29 is a comparison diagram of water delivery pipe vibration acceleration before air is mixed and after the air is mixed.

In the present disclosure, due to the circular forced ventilating mechanism arranged at the front of the water delivery valves and the pressure-stabilizing and vibration-reducing box arranged behind the water delivery valves, cavitation and vibration problems of the water delivery valves are solved, pressure fluctuation is reduced, large-open-degree opening time of the water delivery valves is advanced, water delivery efficiency is improved, and damage of the water delivery valves and the water delivery pipes due to hydrodynamic cavitation is avoided. Based on observation results, it can be seen that: both of the circular forced ventilating mechanism arranged at the front of the water delivery valves and the pressure-stabilizing and vibration-reducing box arranged behind the water delivery valves are combined for the use so as to effectively restrain cavitation and cavitation damage of the water delivery valves, reduce vibration acceleration and improve the water delivery efficiency, namely:

(a) comparing each pressure-stabilizing and vibration-reducing box in the present disclosure with that in the prior art, when acting water head of water delivery valves with the same open degree is generally improved by 5 m, the maximum flow rate is increased from 14.3 $m^3$ to 21.0 $m^3$; water delivery time is shortened from 3213 min to 15.4 min; meanwhile, the pressure-stabilizing and vibration-reducing box greatly improves adverse water flow conditions in the prior art, and in the same open degree mode, root mean square maximum value of the pressure fluctuation is reduced from 2.7 m water column (as shown in FIG. 25) to 0.09 water column (as shown in FIG. 26); water delivery valve relative cavitation number is increased by 30%-40%, and a cavitation resisting function is outstanding; furthermore, root mean square value of maximum acceleration of each measurement point of the pressure-stabilizing and vibration-reducing box is meanly reduced by 36%, and its natural vibration frequency is high and over 1 kHz, so no resonance with water flow fluctuating load occurs, and structure designs and mounting meet vibration-resistance design requirements;

(b) after the circular forced ventilating mechanisms and the pressure-stabilizing and vibration-reducing boxes are jointly used, the pressure fluctuation is further reduced and is generally reduced by about 20%; after the circular forced ventilating mechanisms mix air into the water, air sound level of the water delivery valves is meanly reduced by 5 dB, and water flow noise is steady without abnormal sounds in a range of no reverberant sound; nearly no cavitation fluctuation signal is detected (as shown in FIG. 28), FIG. 27 illustrates the prior art, and the noise intensity is large; cavitation noise pressure level is reduced by 20 dB to 30 dB, air mixing ensures no cavitation operation condition, water delivery pipe vibration acceleration is meanly reduced by 80% to 90%, FIG. 29 illustrates that an air-mixing vibration reducing effect is remarkable, 60% of air can be exhausted, 40% of air enters the vertical shafts 31, no air bag forms, the stability of water surfaces of the vertical shafts 31 are not influenced, and after the air is mixed, fluctuation amplitude of the water surfaces of the vertical shafts 31 is smaller than +/−0.05 m; and (c) after the circular forced ventilating mechanisms and the pressure-stabilizing and vibration-reducing boxes are jointly used, acting water head of the main water delivery valve with the corresponding open degree is largely improved, water delivery time is shortened, and by utilizing a reasonably optimized opening manner, the water delivery time is ensured to be within 15 min.

Figure 30:
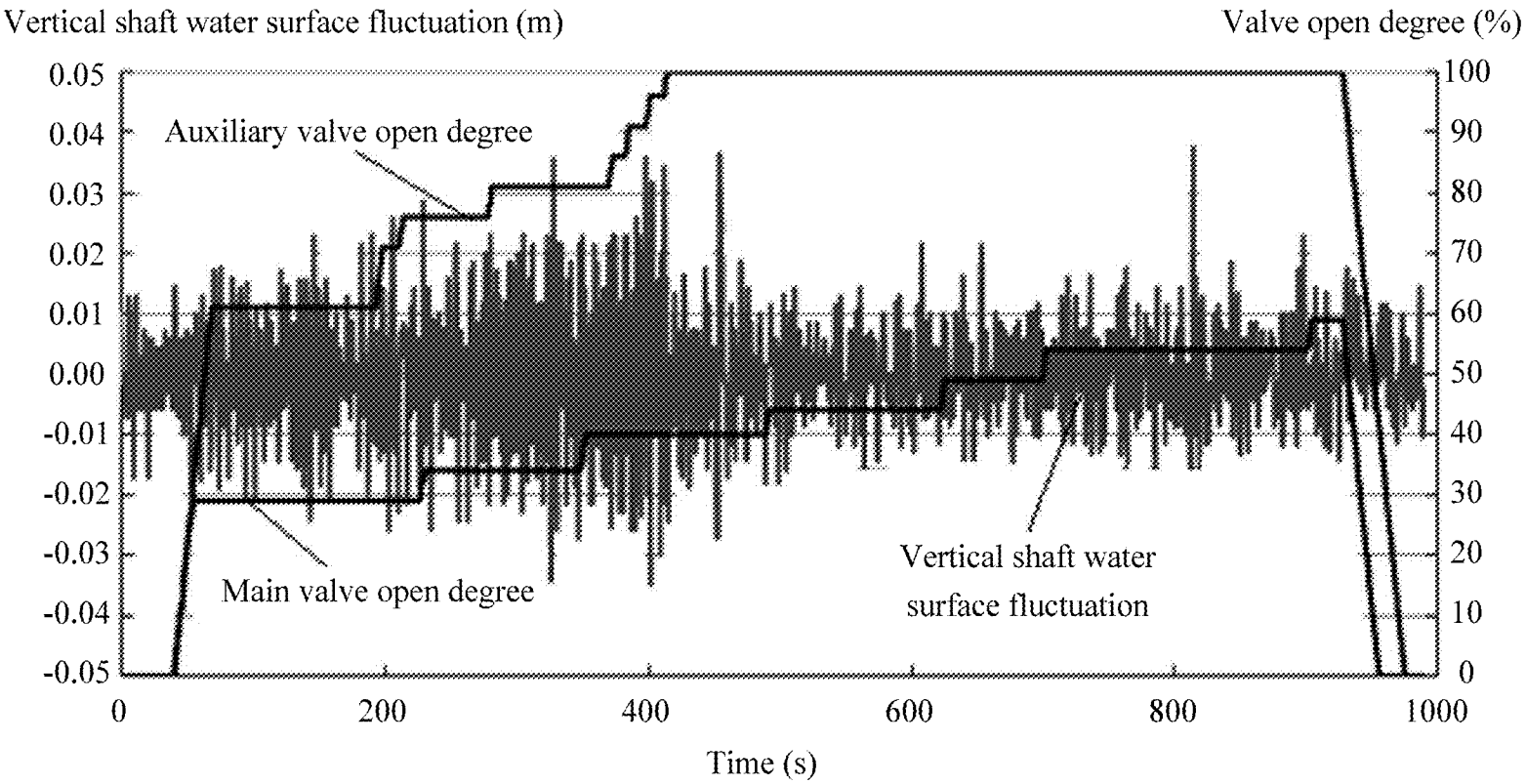
FIG. 30 is a diagram of vertical shaft water surface fluctuation amplitude when the water delivery valves have the same open degree.

Based on prototype observation of the hydraulic ship lift of the present disclosure, it can be seen that: after the hydraulic stabilizing and equalizing system of the present disclosure is optimized and modified, and when the flow rate is over 20 $m^3/s$ and the water delivery time is within 15 min, maximum water surface fluctuation of the vertical shafts is only +/−5 cm, as shown in FIG. 30, the water level difference of the adjacent vertical shafts is smaller than 3 cm, no cavitation condition occurs in a valve operating procedure, and vibration acceleration is largely reduced.

Figure 34:
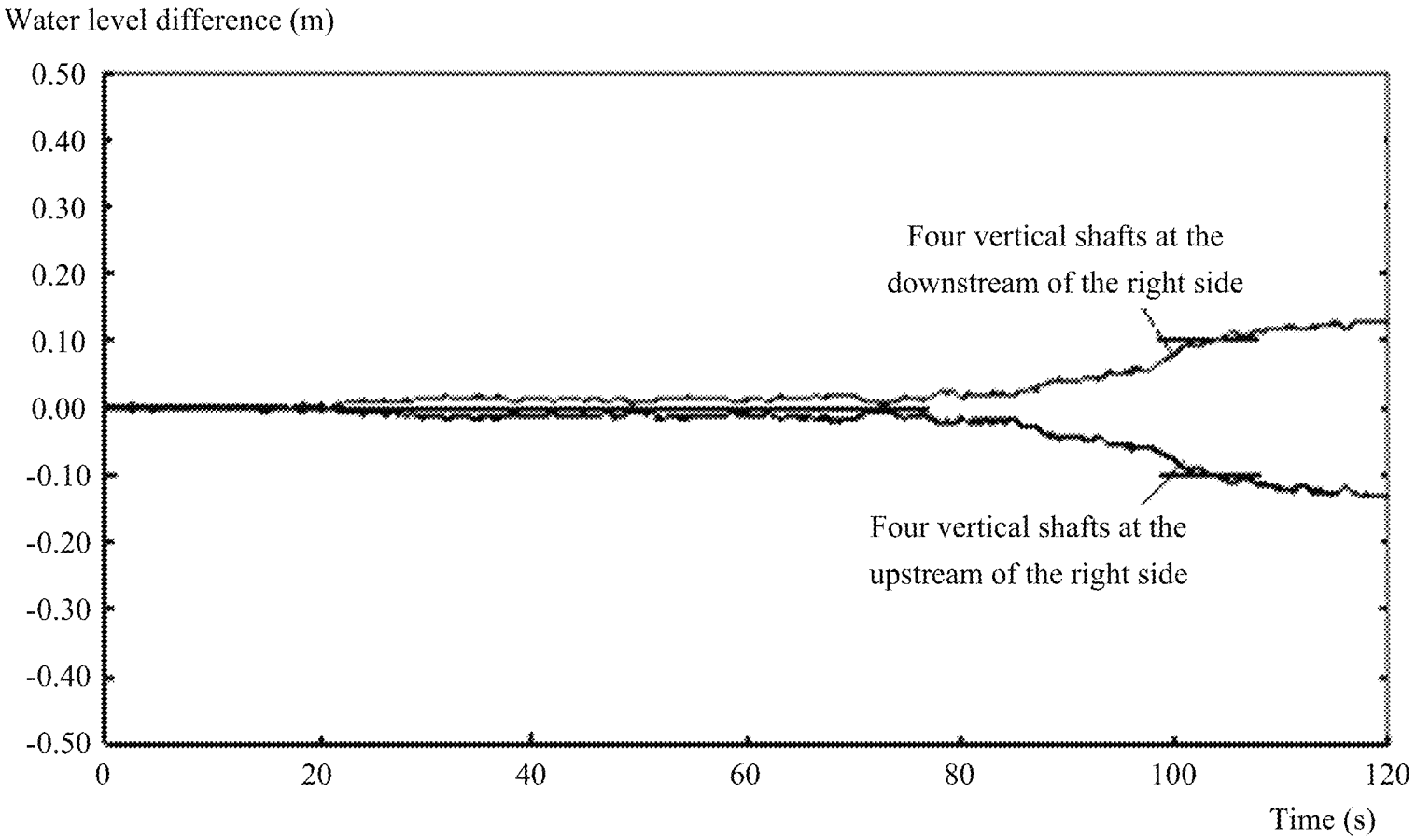
FIG. 34 is a relational diagram of water level differences among the vertical shafts before the water level equalizing galleries are not arranged.
Figure 35:
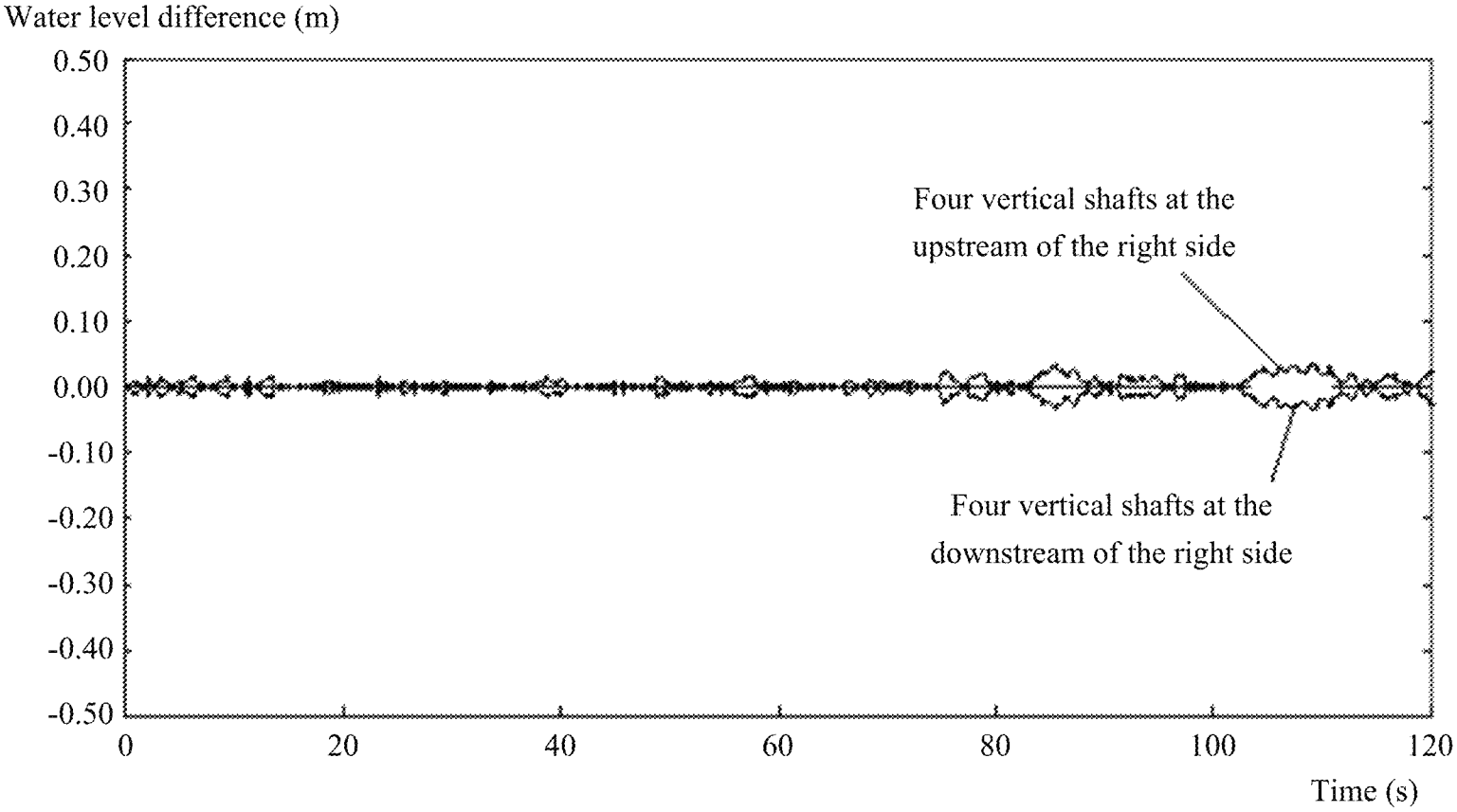
FIG. 35 is an improved diagram of water level differences among the vertical shafts after the water level equalizing galleries are arranged in the present disclosure.

Due to arrangement of the water level equalizing galleries 326 among the vertical shafts 31, the water level difference of the vertical shafts 31 is reduced, and synchronism is improved, as shown in FIG. 35; FIG. 34 is a relational diagram of water level difference among vertical shafts 31 before the water level equalizing galleries 326 are not arranged, and obviously the arrangement of the water level equalizing galleries 326 greatly improve the water level difference among the vertical shafts 31, as shown in FIG. 35, so that the level of each vertical shaft 31 is close to be equal.

The foregoing fully shows that hydrodynamic synchronism of the utilized stabilizing and equalizing hydraulic driving system is good, and excellent hydrodynamic conditions are provided for reduction of the torque of the synchronizing shaft and stable operation of the ship reception chamber.

The self-feedback stabilizing system of the ship reception chamber fulfills the following principles and methods:

to improve adaptive capacity of a guide wheel mechanism to guide rail precision, control maximum deformation of the guide wheel mechanism, and prevent ship reception chamber self-feedback stabilizing system failure caused by flexible member failure, the self-feedback stabilizing system of the ship reception chamber fulfills the following principles and methods:

(1) overturning moment after the ship reception chamber tilts is calculated by the following formula:

$$N_{af}=(1/2\times 2\Delta\times L_c)\times B_c\times(2/3L_c-1/2L_c)\text{ unit: t·m}$$

anti-overturning moment of the guide wheel mechanism is calculated by the following formula:

$$N_{kf}=4\times(2\Delta/L)\times L^*\times K^*\times L^*\text{ unit: t·m}$$

in the foregoing two formulas:

$L_c$ is length of the ship reception chamber and its unit is m;

$B_c$ is width of the ship reception chamber and its unit is m;

L* is an interval of guide wheels on the same side of the guide wheel mechanism, and its unit is m;

K* is rigidity of the flexible members in the guide wheel mechanism and its unit is t/m;

Δ is a tilt of a ship reception chamber and its unit is m; by taking the transverse center line of the ship reception chamber as reference, one end is reduced by "Δ", one end is increased by "Δ", and the height difference of these two ends is "2Δ"; and L is the length of the ship reception chamber.

(2) the rigidity of the flexible members in the guide wheel mechanism fulfills the following formula:

$$K^*=N_{kf}/N_{af}$$

K*>1 represents that the guide wheel mechanism has an anti-overturning capability;

K*<1 represents that the guide wheel mechanism does not have the anti-overturning capability; and K*=1 represents that the guide wheel mechanism provides an unstable anti-overturning capability.

(3) clearance of the limiting stoppers in the guide wheel mechanism fulfills the following principles and methods:

maximum unevenness of the guide rail is supposed to be δ, so, in the operation procedure, along with the rolling of the guide wheels, rotation displacement at clearance of the guide wheel is:

$$\delta^*=(a^*/b^*)\times\delta$$

to prevent the guide wheel operation from jamming, the following condition is fulfilled:

$$\delta^*>\delta$$

Other settings of the self-feedback stabilizing system are carried out by routine.

Figure 31:
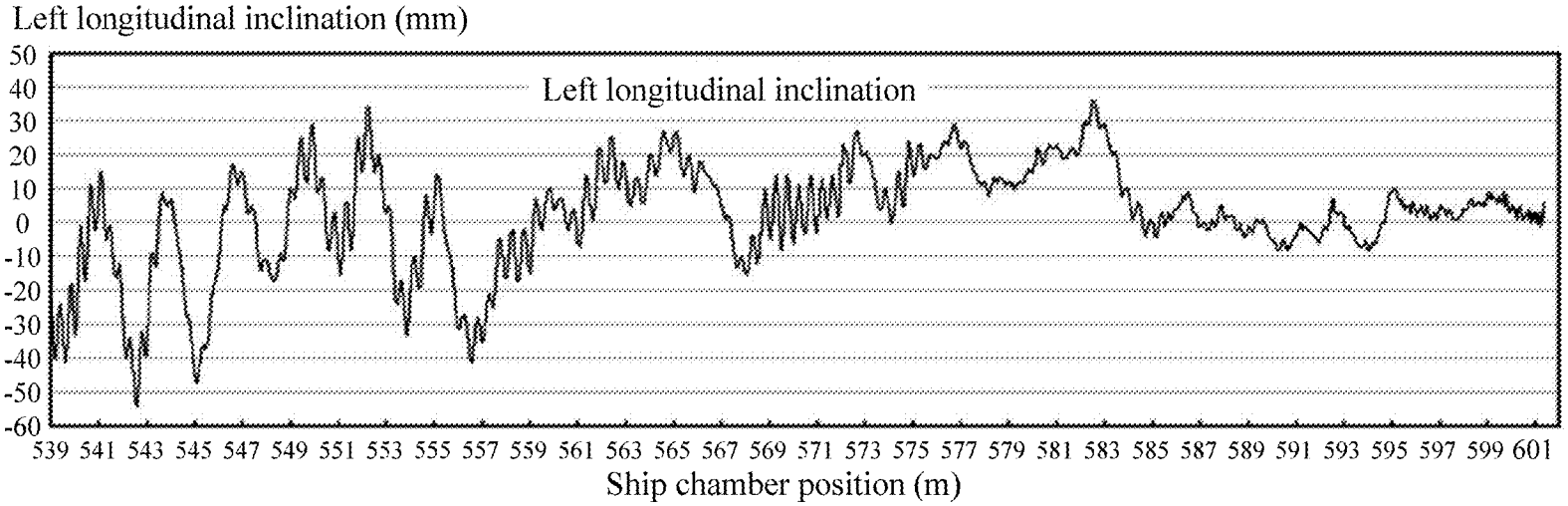
FIG. 31 is a diagram of variation with distance of upstream longitudinal tilt of the ship reception chamber.
Figure 32:
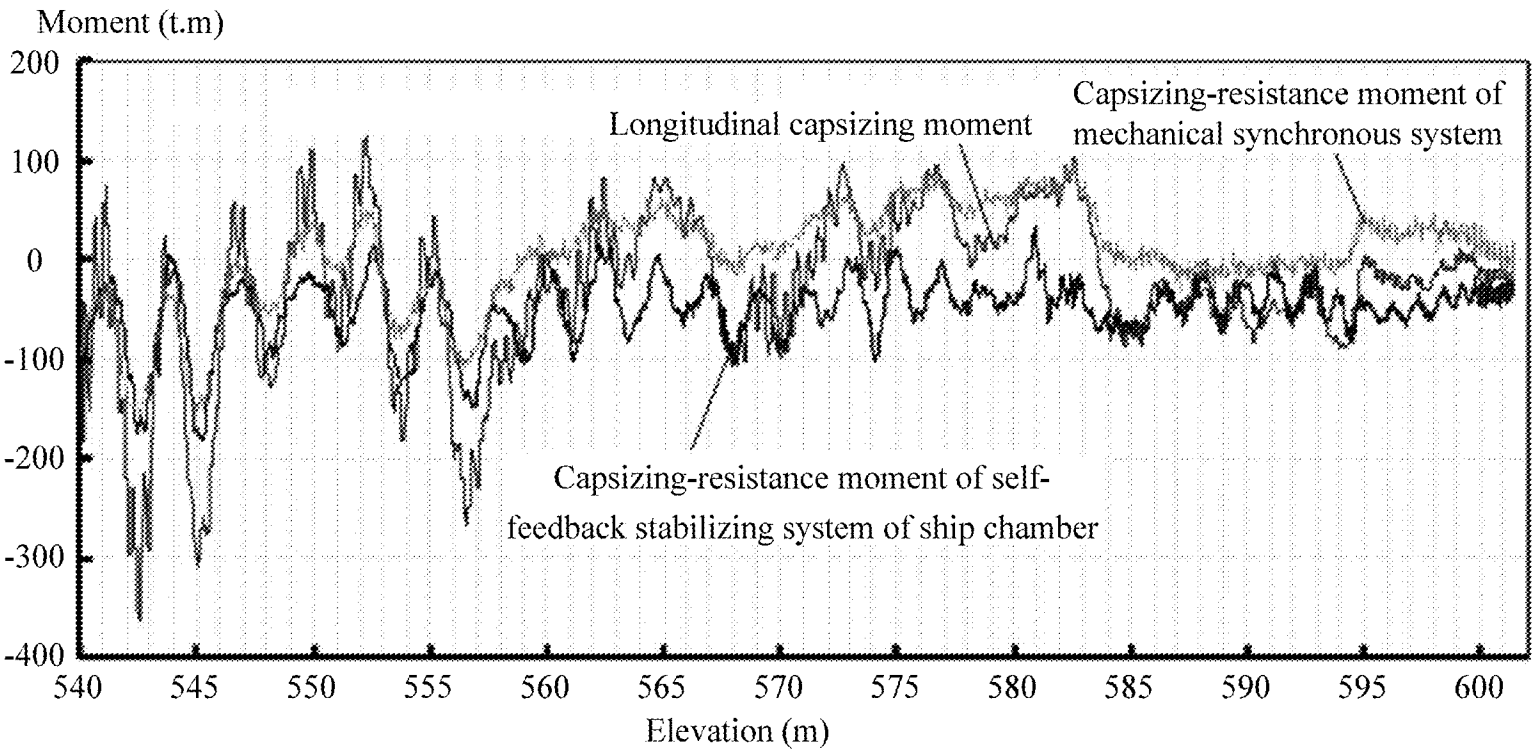
FIG. 32 is a diagram of variations with distance of longitudinal overturning moment of the ship reception chamber, anti-overturning moment of the mechanical synchronizing system and anti-overturning moment of the self-feedback stabilizing system.
Figure 33:
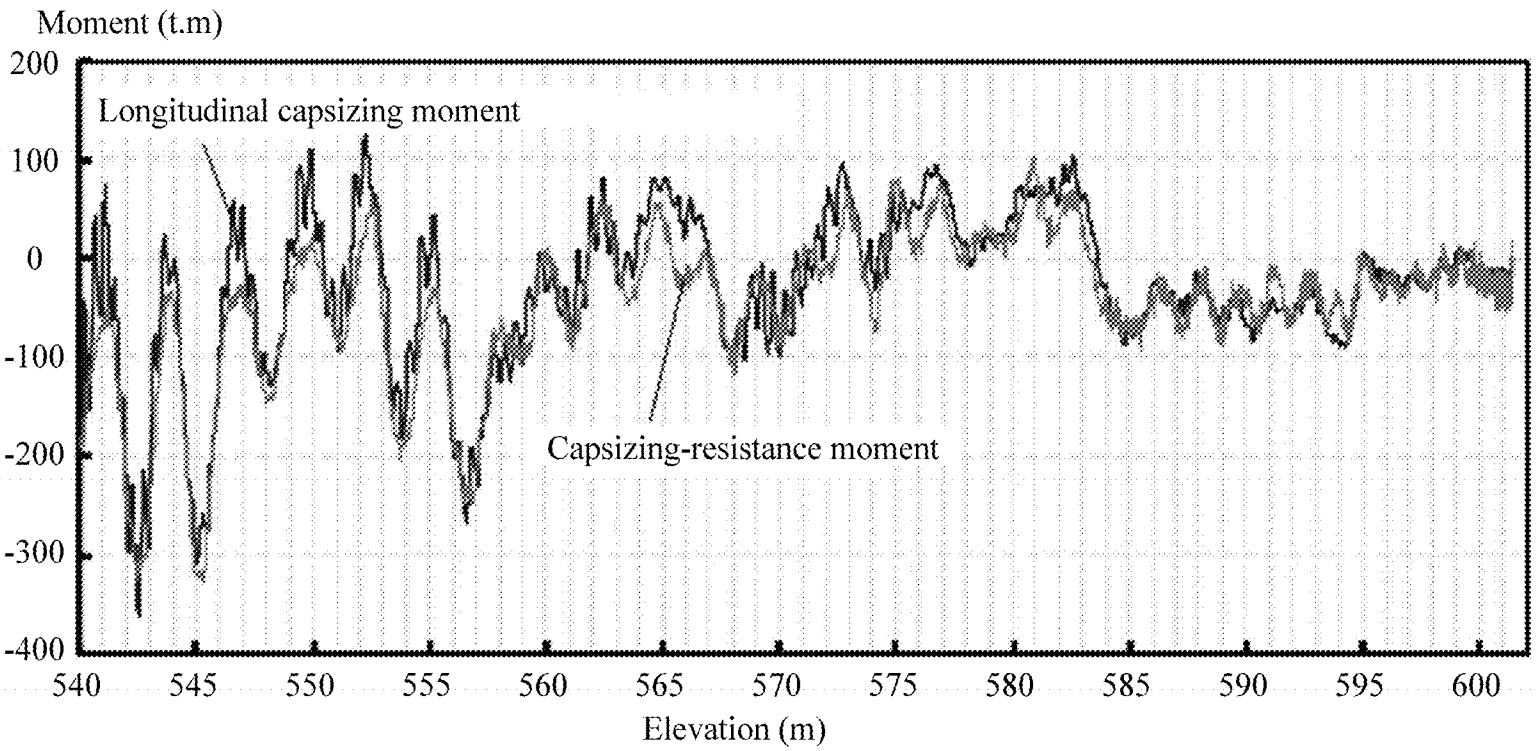
FIG. 33 is a diagram of variations with distance of longitudinal overturning moment and anti-overturning moment of the ship reception chamber.

Due to arrangement of the self-feedback stabilizing system of the ship reception chamber, the ship reception chamber with water operates in whole upstream and downstream procedures on the basis of level and stabilization, wherein variation with distance of upstream longitudinal tilt of the ship reception chamber is as shown in FIG. 31, variations with distance of longitudinal overturning moment and anti-overturning moment of the ship reception chamber are as shown in FIG. 32 and FIG. 33, it can be seen that longitudinal overturning of the ship reception chamber shows a stable fluctuation procedure, fluctuation amplitude is relatively smaller and can be recovered after every tilt, maximum longitudinal tilt in the upstream procedure is about 50 mm, maximum guide wheel pressure is smaller than 20 t, the self-feedback stabilizing system and the mechanical synchronizing system of the ship reception chamber commonly bear the longitudinal overturning moment of the ship reception chamber, the sum of their anti-overturning moments basically matches with the longitudinal overturning moment, and the ship reception chamber is always under a stable and convergent condition, thereby solving a problem that severe tilt of the ship reception chamber is over 300 mm and is gradually increased when the self-feedback stabilizing system of the ship reception chamber is not arranged along the distance; certainly anti-overturning capability of the self-feedback stabilizing system of the ship reception chamber with the distance are remarkable, so that unstable divergence characteristic of a mechanical lifting system of the hydraulic ship lift generates fundamental change and becomes a stable and convergent system.

Based on the foregoing implementation scheme, it shows that: the stabilizing and equalizing hydraulic driving system achieves synchronous, stable, quick and efficient hydraulic conditions, establishes the foundation for stable and efficient operation of the ship lift; the mechanical synchronizing system reduces the tilt of the ship reception chamber and the torque of the synchronizing shaft, and provides conditions for safe and stable operation of the ship lift; and the self-feedback stabilizing system of the ship reception chamber can flexible fit unevenness of the guide rails and ensures that the ship reception chamber horizontally and stably lifts up and down, and under minor fluctuation, the tilt and the stress are further reduced. Therefore, the foregoing multiple systems jointly work to form a hydraulic ship lift with anti-overturning capability, and ensures that the hydraulic ship lift can stably and efficiently operate.

In the present disclosure, coupling effects of each system and anti-overturning capability protection mechanism to the whole ship reception chamber are as follows.

The stabilizing and equalizing hydraulic driving system, the active anti-overturning capability mechanism synchronizing system and the self-feedback stabilizing system of the ship reception chamber jointly work, and their anti-overturning capability interaction relations are as shown in FIG. 5. In FIG. 5, AB is a tilt moment change curve generated by the tilted ship reception chamber, JHC is an anti-overturning moment curve generated by the self-feedback stabilizing system of the ship reception chamber, EF is an anti-overturning moment curve generated by the active anti-overturning capability mechanism synchronizing system, and JHI is anti-overturning moment provided by multiple systems.

The stabilizing and equalizing hydraulic driving system mainly controls the value of the initial overturning moment value A of the ship reception chamber, and eliminates unbalanced loads of the ship reception chamber and disturbance of the water body in the ship reception chamber by reducing vertical shaft water level difference and ship reception chamber operating speed fluctuation. FIG. 5 shows reducing the value of the initial disturbance overturning moment value A of the tilt moment curve AB of the ship reception chamber.

Preloads and rigidity of the self-feedback stabilizing system mainly control the value of initial tilt disturbance resistance value J to the ship reception chamber. The clearance of the active anti-overturning capability mechanism synchronizing system influences the value of the initial tilt value E of the ship reception chamber when the system starts exerting the anti-overturning capability. The rigidity of the self-feedback stabilizing system and the active anti-overturning capability mechanism synchronizing system decides slope of the anti-overturning moment curves JHC and EF, and the larger the rigidity is, the larger the slope value is, and the stronger the anti-overturning capability is.

An interaction relation of the self-feedback stabilizing system and the active anti-overturning capability mechanism synchronizing system is divided into three stages to exert an integral anti-overturning capability of the ship reception chamber:

at first stage, before synchronizing shaft clearance is eliminated (DE), the active anti-overturning capability mechanism synchronizing system does not fully exert the anti-overturning capability, and the self-feedback stabilizing system bears the initial overturning moment of the ship reception chamber to exert a leading function of keeping the ship reception chamber stable;

at second stage, it is from the moment after the synchronizing shaft clearance is eliminated to a working range of the self-feedback stabilizing system (EG), the self-feedback stabilizing system and the active anti-overturning capability mechanism synchronizing system commonly exert the main anti-overturning capability of the ship reception chamber, proportion of the anti-overturning capability achieved by both of the self-feedback stabilizing system and the mechanical synchronizing system is related to the rigidity of the self-feedback stabilizing system and the mechanical synchronizing system, and the larger the rigidity of the mechanical synchronizing system is, the larger the proportion of the anti-overturning capability achieved by the mechanical synchronizing system at the EG stage is.

at third stage, the tilt of the ship reception chamber is over a working range (larger than point G) of the self-feedback stabilizing system of the ship reception chamber, the self-feedback stabilizing system exerts a tilt of a ship reception chamber limiting function, and the continuously increased overturning moment of the ship reception chamber is born by the mechanical synchronizing system.

When the tilt of the ship reception chamber is over G, the stabilizing and equalizing hydraulic driving system is closed, the ship reception chamber of the ship lift stops operating, the brakes on the drums in the active anti-overturning capability mechanism synchronizing system start to work so as to prevent the drums from rotating, and the continuously increased overturning moment of the ship reception chamber is born by the brakes on the drums.

The invention claimed is:

1. A hydraulic ship lift, comprising:

a ship reception chamber for containing a ship;

a plurality of wire ropes; and a stabilizing and equalizing hydraulic driving system, the stabilizing and equalizing hydraulic driving system comprising:

a plurality of vertical shafts;

a plurality of floats;

a water delivery main pipe, the water delivery main pipe comprising a plurality of water delivery valves;

a plurality of branch water pipes, each branch water pipe comprising a straight pipe at a lower part, a plurality of straight pipes at an upper part, and a plurality of angle pipes and a plurality of bifurcated pipes at a middle part;

a plurality of first resistance equalizing members or/and a plurality of second resistance equalizing members:

a plurality of circular forced ventilating mechanisms; and a plurality of pressure-stabilizing and vibration-reducing boxes;

wherein:

the water delivery main pipe is connected to the straight pipe at the lower part of each branch water pipe;

in each branch water pipe, each angle pipe is connected to one bifurcated pipe, and the straight pipe at the lower part is connected to the straight pipes at the upper part via the angle pipes and the bifurcated pipes;

a water outlet end of each straight pipe at the upper part in each branch water pipe is arranged at a bottom of one vertical shaft;

each float is disposed in one vertical shaft;

each float is connected to the ship reception chamber via one wire rope;

the water delivery main pipe is adapted to supply water through the branch water pipes into the vertical shafts to raise the floats for lowering the ship reception chamber;

when the stabilizing and equalizing hydraulic driving system comprises the first resistance equalizing members, each first resistance equalizing member is arranged at a corner of one angle pipe;

when the stabilizing and equalizing hydraulic driving system comprises the second resistance equalizing members, each second resistance equalizing member is arranged at one bifurcated pipe;

each circular forced ventilating mechanism is arranged at front of one water delivery valve; and each pressure-stabilizing and vibration-reducing box is arranged behind one water delivery valve.

2. The hydraulic ship lift of claim 1, further comprising a lock chamber and a self-feedback stabilizing system, wherein:

the ship reception chamber is disposed within the lock chamber;

the self-feedback stabilizing system comprises a plurality of guide rails, a plurality of guide wheels, and a plurality of supporting mechanisms; and each supporting mechanism comprises a base, a support, a flexible member, and a limiting stopper;

the guide rails are arranged on two inner side walls of the lock chamber and the guide wheels are arranged at corresponding upper part and lower part of the ship reception chamber, each guide wheel matches and is adapted to roll along one guide rail, and each guide wheel is fixed on the ship reception chamber through one supporting mechanism;

for each supporting mechanism, the base is connected to the ship reception chamber, the support is articulated on the base, the flexible member is fixedly arranged between the base and the support, and the limiting stopper is arranged on an outer side of the base and adapted to confine the flexible member; the support comprises two oppositely arranged triangular plates, right-angle parts of the two triangular plates are fixed on a bulge on an inner side of the base through a hinge shaft, the flexible member is arranged between horizontal outer ends of the two triangular plates and the outer side of the base, and one guide wheel is fixedly arranged between the two triangular plates through an axle above the right-angle parts; and the guide rails comprise two guide rails arranged along one of the two inner side walls of the lock chamber, and two guide rails arranged along the other of the two inner side walls of the lock chamber; two side walls of each guide rail match four guide wheels, including two guide wheels at the upper part of the ship reception chamber and two guide wheels at the lower part of the ship reception chamber; two horizontal metal plates or two right-angle plates are respectively arranged on the two side walls of each guide rail to match four guide wheels.

3. The hydraulic ship lift of claim 1, wherein:

the stabilizing and equalizing hydraulic driving system comprises a plurality of energy dissipaters and a water level equalizing gallery;

each energy dissipater is arranged around the water outlet end of one straight pipe at the upper part in one branch water pipe;

the vertical shafts are communicated with each other through the water level equalizing; gallery; and the bottom of each float is a cone of 120 degrees, and a clearance ratio of one vertical shaft to a corresponding float is between 0.095 and 0.061.

4. The hydraulic ship lift of claim 1, wherein:

when the stabilizing and equalizing hydraulic driving system comprises the first resistance equalizing members, each first resistance equalizing member is a closed pipe head extending downwards from the corner of one angle pipe;

when the stabilizing and equalizing hydraulic driving system comprises the second resistance equalizing members, each second resistance equalizing member is a solid or hollow cone, wherein, the upper end of the cone is fixed on the wall of a horizontal pipe of one bifurcated pipe, and the lower end of the cone extends into an upright pipe of the one bifurcated pipe;

each circular forced ventilating mechanism comprises a ventilating ring pipe fixed at the exterior of the water delivery main pipe, wherein, a first through hole is formed in the inner side wall of the ventilating ring pipe, the first through hole is communicated with a second through hole formed in the wall of the water delivery main pipe, a third through hole is formed in the outer side wall of the ventilating ring pipe, the third through hole is connected to an air supply pipe, and the air supply pipe is connected to an air source; and each pressure-stabilizing and vibration-reducing box comprises a housing and an outer beam system, a cavity is formed in the housing, water inlets and a water outlet are disposed on the housing, the outer beam system is arranged on the outer wall of the housing, and inner beam system fences are arranged in the cavity at intervals; wherein, each inner beam system fence comprises a hollow plate formed by crisscrossed vertical rods and horizontal rods to match the shape of a cross section of the cavity, and tension diagonals are arranged in hollowed parts of the hollow plate; the crisscrossed vertical rods and horizontal rods, and the tension diagonals are solid or hollow tubes, and groove-shaped reinforcing plates are arranged at crisscrossed parts of the vertical rods and the horizontal rods; and cushion plates are arranged at connection parts between the inner beam system fences and the side walls of the cavity and at connection parts between the inner beam system fences and the bottom walls of the cavity.

5. The hydraulic ship lift of claim 4, wherein in each pressure-stabilizing and vibration-reducing box:

a manhole for overhauling is formed in the housing a gas collection groove is arranged at the back part of the interior of the housing, exhaust holes are disposed in the top of the gas collection groove, and the exhaust holes are connected to an exhaust pipe;

the outer beam system coats the whole outer wall of the housing, the outer beam system comprises four main cross beam plates, a plurality of secondary cross beam plates, a plurality of vertical beam plates and a plurality of horizontal beam plates;

the main cross beam plates have the same height and are arranged at intervals;

the secondary cross beam plates are disposed between each pair of the main cross beam plates and are shorter than the main cross beam plates;

the vertical beam plates are vertical to the main cross beam plates and the secondary cross beam plates, and the vertical beam plates have the same height and are arranged at intervals;

the horizontal beam plates have the same width and length and are arranged at intervals;

the secondary cross beam plates, the vertical beam plates, and the horizontal beam plates are intertwined and connected to each other to form the outer beam system; and a sunken variable-cross-section beam plate set is disposed at the water inlets, and the outer side of the variable-cross-section beam plate set is level with the end face of a flange; and the water inlets comprises three water inlets that are connected to the water delivery main pipe respectively through three water delivery valves, wherein the water delivery valve at the middle part is a main valve, the water delivery valves on the two sides are auxiliary valves, and three circular forced ventilating mechanisms are respectively arranged at parts, located at the front of the one main valve and the two auxiliary valves, of the water delivery main pipe.

6. The hydraulic ship lift of claim 1, further comprising a mechanical synchronizing system, wherein:

the mechanical synchronizing system comprises the plurality of wire ropes, a plurality of drums, a plurality of couplings, a plurality of synchronizing shafts, two horizontal synchronizing shafts, and two bevel gear pairs;

one ends of the wire ropes are connected to two sides of the ship reception chamber, the other ends of the wire ropes are fixed on the floats at the tops of the vertical shafts, wherein each wire rope extends through one drum and a pulley disposed on one float;

the drums are disposed on top of the hydraulic ship lift, and the drums are connected to each other through the synchronizing shafts and the couplings; and the drums, the couplings and the synchronizing shafts form two rows bearing the wire ropes on the two sides of the ship reception chamber, and the two rows are connected to the two horizontal synchronizing shafts through the two bevel gear pairs and the couplings to form a rectangular frame connection; and a conventional brake is arranged on each drum.

7. A method for operating a hydraulic ship lift, the hydraulic ship lift comprising:

a ship reception chamber;

a mechanical synchronizing system comprising wire ropes, synchronizing shafts, and drums each having a brake;

a stabilizing and equalizing hydraulic driving system; and a self-feedback stabilizing system; and the method comprising:

(1) at a first stage, a tilt of the ship reception chamber is $0 \leq \Delta < \theta R$;

at this stage, an anti-overturning moment of the self-feedback stabilizing system fulfills the following formula:

$$K_d \times \Delta + M_{d0} = M_d > \gamma_d \times (M_c + M_w) = \gamma_d \times (K_c \times \Delta + M_w)$$

an overall anti-overturning rigidity of the self-feedback stabilizing system fulfills the following formula:

$$K_d > \gamma_d \times \left(K_c + \frac{M_w - M_{d0}/\gamma_d}{\Delta}\right)$$

in the formulas:

an overturning moment generated by a tilted ship reception chamber is $M_c = K_c \times \Delta$, and its unit is kN·m;

an overturning rigidity of the ship reception chamber is $K_c$ and its unit is kN;

the tilt of the ship reception chamber is $\Delta$ and its unit is m;

an initial overturning moment of the ship reception chamber generated by the stabilizing and equalizing hydraulic driving system is $M_w$, and its unit is kN·m;

a total overturning moment of the ship reception chamber is $M_c + M_w = K_c \times \Delta + M_w$ and its unit is kN·m;

the anti-overturning moment of the self-feedback stabilizing system is $M_d = K_d \times \Delta + M_{d0}$ and its unit is kN·m;

a pre-loading anti-overturning moment of the self-feedback stabilizing system is $M_{d0}$ and its unit is kN·m;

the overall anti-overturning rigidity of the self-feedback stabilizing system is $K_d$ and its unit is kN;

a safety coefficient $\gamma_d$ of the self-feedback stabilizing system is 1.5-2.0;

(2) at a second stage, the tilt of the ship reception chamber is $\theta R \leq \Delta <_{max}$;

this stage is defined from a moment that a clearance of the mechanical synchronizing system is eliminated to a moment that the tilt of the ship reception chamber is smaller than a designed allowable limit tilt value $\Delta_{max}$; at this stage, the self-feedback stabilizing system and the synchronizing shafts of the mechanical synchronizing system jointly bear an anti-overturning capability to the ship reception chamber, the synchronizing shafts of the mechanical synchronizing system exert the main anti-overturning capability, and a proportion of the anti-overturning capability achieved by the self-feedback stabilizing system and the mechanical synchronizing system is related to the overall anti-overturning rigidity $K_d$ of the self-feedback stabilizing system and an overall anti-overturning rigidity $K_T$ of the mechanical synchronizing system; total anti-overturning moments of the self-feedback stabilizing system and the mechanical synchronizing system fulfill the following formula:

$$K_d \times \Delta + M_{d0} + K_T \times (\Delta - \theta R) = M_d + M_T > (\gamma_d + \gamma_T) \times (M_c + M_w) = (\gamma_d + \gamma_T) \times (K_c \times \Delta + M_w)$$

the overall anti-overturning rigidity of the mechanical synchronizing system fulfills the following formula:

$$K_T > \frac{(\gamma_d + \gamma_T) \times (K_c \times \Delta + M_w) - K_d \times \Delta - M_{d0}}{(\Delta - \theta R)}$$

in the formulas:

an anti-overturning moment of the synchronizing shafts of the mechanical synchronizing system is $M_T = K_T \times (\Delta - \theta R)$ and its unit is kN·m;

the clearance of the mechanical synchronizing system is $\theta$ and its unit is radian;

a radius of each drum is R and its unit is m;

the overall anti-overturning rigidity of the mechanical synchronizing system is $K_T$ and its unit is kN;

a safety coefficient of the mechanical synchronizing system is $\gamma_T$ of 6-7;

the clearance of the mechanical synchronizing system decides a moment at which the mechanical synchronizing system starts exerting the anti-overturning capability;

the overall anti-overturning rigidity $K_T$ of the mechanical synchronizing system decides the value of an anti-overturning moment for the ship reception chamber;

(3) at a third stage, the tilt of the ship reception chamber is $\Delta \geq \Delta_{max}$;

when the tilt of the ship reception chamber exceeds the designed allowable maximum tilt value $\Delta_{max}$, the self-feedback stabilizing system limits the tilt of the ship reception chamber; a continuously increased overturning moment of the ship reception chamber is exerted on the mechanical synchronizing system; at this stage, the stabilizing and equalizing hydraulic driving system is closed, the ship reception chamber of the ship lift stops operating, the brakes on the drums of the mechanical synchronizing system start to operate, the continuously increased overturning moment of the ship reception chamber is born by the brakes on the drums; and a total drum braking force fulfills the following formula:

$$F_z \geq \gamma_z \times F_c$$

in the formula:

the total drum braking force is $F_z$ and its unit is kN;

a total weight of the water body in the ship reception chamber is $F_c$ and its unit is kN; and a safety coefficient $\gamma_z$ of the total drum braking force is 0.4-1.0.

8. The method of claim 7, wherein in the mechanical synchronizing system:

the mechanical synchronizing system has double functions of anti-overturning capability and transferring and equalizing unbalanced loads of the ship reception chamber, the system actively generates an anti-overturning moment to the ship reception chamber through minor deformation of the synchronizing shafts, and when the tilt of the ship reception chamber and a torque of the synchronizing shafts reaches a designed value, the brakes arranged on the drums lock the drums, thereby ensuring the integral safety of the ship lift;

the mechanical synchronizing system is symmetric, the ship reception chamber is leveled, stress and friction of each drum and each wire rope are totally the same, and rigidity influence from the ship reception chamber and the wire ropes are ignored, so that a rigidity and a intensity of the mechanical synchronizing system fulfill the following:

I. rigidity setting method a maximum tilt load $\Delta P$ acting on the mechanical synchronizing system by the tilted ship reception chamber is calculated according to the following formula:

$$\Delta P = \frac{(\Delta h + \Delta h_0)L_c B_c \rho g}{24} + \frac{M_b + M_p}{2L_c} \quad (1)$$

in the formula:

$\Delta h$ is a tilt of the ship reception chamber caused by the deformation of the synchronizing shafts under the unbalanced loads and a total clearance of the synchronizing shafts, and its unit is m;

$\Delta h_0$ is a tilt of the ship reception chamber caused by machining and mounting errors of the drums and the wire ropes when the ship reception chamber lifts up and down, and its unit is m;

$L_c$ is a length of the ship reception chamber and its unit is m;

$B_c$ is a width of the ship reception chamber and its unit is m;

$\rho$ is a density of the ship reception chamber and its unit is $kg/m^3$;

g is gravitational acceleration and its unit is $m/s^{-2}$;

$M_b$ is an overturning moment caused by water surface fluctuation of the ship reception chamber and its unit is kN·m;

$M_p$ is an overturning moment caused by eccentric loads of the ship reception chamber and its unit is kN·m;

when the tilt $\Delta h$ of the ship reception chamber is formed by the deformation of the synchronizing shafts under the unbalanced loads and the total clearance of the synchronizing shafts, an anti-overturning force $\Delta F$, which is acting on the ship reception chamber through the drums, of the mechanical synchronizing system is calculated according to the following formula:

$$\Delta F = \frac{\Delta h - \theta_2 R + 4M_f R \sum_{i=1}^{n} \frac{L_i}{GI_{pi}}}{R^2 \sum_{i=1}^{n} \frac{L_i}{GI_{pi}}} \quad (2)$$

in the formula:

$\Delta F$ is the anti-overturning force acting on the ship reception chamber and its unit is kN;

$\Delta h$ is the tilt of the ship reception chamber caused by the deformation of the synchronizing shafts under the unbalanced loads and the total clearance of the synchronizing shafts, and its unit is m;

$\theta_2$ is the total clearance of the synchronizing shafts and its unit is radian;

R is the radius of each drum and its unit is m;

$M_f$ is a torque generated by a friction force of a single drum and its unit is kN·m;

G is a shear modulus of elasticity and its unit is kPa;

$L_i$ is a length of the i-th synchronizing shaft and its unit is m;

$I_{pi}$ is a polar moment of inertia of the section of the i-th synchronizing shaft, wherein:

$$I_p = \frac{\pi D^4}{32}(1 - a^4)$$

D is an outer diameter of a synchronizing shaft;

a is an inner diameter/outer diameter of a hollow synchronizing shaft; if it is a solid synchronizing shaft, the inner diameter is equal to 0, namely a =0;

therefore, in the absence of the intensity loss of the synchronizing shafts:

(1) $\Delta F > \Delta P$, the tilt $\Delta h$ of the ship reception chamber is reduced when the deformation of the synchronizing shafts under the unbalanced loads and the total clearance of the synchronizing shafts cause the ship reception chamber to incline by $\Delta h$, and the anti-overturning force $\Delta F$ acting on the ship reception chamber by the drums is larger than maximum tilt load $\Delta P$ acting on the mechanical synchronizing system by the tilted ship reception chamber;

(2) $\Delta F < \Delta p$, when the tilt $\Delta h$ of the ship reception chamber is continuously increased, the synchronizing shafts need to generate larger torsional deformation and generate a larger resistance force, so that the balance of the ship reception chamber can be ensured;

(3) $\Delta F = \Delta P$, when the anti-overturning force $\Delta F$ acting on the ship reception chamber by the drums is equal to the maximum tilt load $\Delta P$ acting on the mechanical synchronizing system by the tilted ship reception chamber, the ship reception chamber is stable, so:

$$\beta = \frac{L_c B_c \rho g}{24}, \ \delta = R \sum_{i=1}^{n} \frac{L_i}{GI_{pi}}$$

when the ship reception chamber is stable, $\Delta F = \Delta P$, the following conditions are fulfilled:

$$\Delta h = \frac{\theta_2 R}{1 - \beta\delta R} + \frac{\Delta h_0 \beta\delta R}{1 - \beta\delta R} + \frac{\delta R(M_b + M_p)}{2L_c(1 - \beta\delta R)} - \frac{4\delta M_f}{1 - \beta\delta R} \quad (3)$$

due to $\Delta h \geq 0$, the rigidity of the mechanical synchronizing system is defined as $$K = \frac{1}{\sum_{i=1}^{n} \frac{L_i}{GI_{pi}}},$$

and when $1 < \beta\delta R$ and the following formula (4) is met, the mechanical synchronizing system keeps the ship reception chamber stable:

$$K > \frac{L_c B_c \rho g R^2}{24} \quad (4)$$

when the ship reception chamber lifts up and down, an allowable maximum tilt of the ship reception chamber is $\Delta h_{max}$, so that the rigidity of the mechanical synchronizing system fulfills the formula (5):

$$\gamma_1(\theta_2 R + \Delta h_0) + \gamma_2(M_b + M_p) - \gamma_3 M_f \leq \Delta h_{max} \quad (5)$$

in the formula:

(1) $\gamma_1(\theta_2 R + \Delta h_0)$ is a tilt of the ship reception chamber caused by manufacturing errors, namely a tilt of the ship reception chamber caused by the clearance of the mechanical synchronizing system and wire rope errors, wherein $$\gamma_1 = \frac{1}{1-\beta\delta R}$$

is defined as a manufacturing error tilt coefficient, $\gamma_1$ is related to the dimension of the ship reception chamber and a rigidity of the synchronizing shafts, $\gamma 1 \in [1,+\infty)$ can be seen by combining with the formula (5), and $\gamma_1$ is a numerical value larger than or equal to 1 according to the definition of the coefficient $\gamma_1$; the larger the rigidity of the synchronizing shafts is, the smaller the value of $\gamma_1$ is, but the value of $\gamma_1$ is not smaller than 1; and when the rigidity of the synchronizing shafts is infinitely large, $\gamma_1=1$, and at this point, the maximum tilt of the ship reception chamber caused by the manufacturing errors is $\theta_2R+\Delta h_0$;therefore, $\gamma_1$ exerts an enlarging function to the tilt of the ship reception chamber caused by the manufacturing errors, wherein the smaller the rigidity of the synchronizing shafts is, the larger the enlarging function to the tilt of the ship reception chamber caused by the manufacturing errors is; and the larger the rigidity of the synchronizing shafts is, the smaller the enlarging function to the tilt of the ship reception chamber caused by the manufacturing errors is;

(2) $\gamma_2(M_b+M_p)$ is a tilt $\Delta H_2$ of the ship reception chamber caused by an overturning moment, namely a tilt of the ship reception chamber generated under the action of an overturning moment of the ship reception chamber caused by the water surface fluctuation and the eccentric loads of the ship reception chamber, wherein $$\gamma_2 = \frac{\delta R}{2L(1-\beta\delta R)}$$

is defined as a fluctuation tilt coefficient, $\gamma_2 \to 0$ when the rigidity of the synchronizing shafts is infinitely large, and at this point, influence on the tilt of the ship reception chamber due to the overturning moment caused by the water surface fluctuation is smaller;

(3) $-\gamma_3 M_f$ is a resistance, generated by a system friction force, to the tilt of the ship reception chamber, wherein $$\gamma_3 = \frac{4\delta}{1-\beta\delta R}$$

is defined as a friction force tilt resistance coefficient, and the larger the system friction force is, the more the reduction of the tilt of the ship reception chamber;

II. intensity setting method the torque of the synchronizing shafts $T_N$ during operation of the ship reception chamber is expressed as follows:

$$T_N=\varphi_1[M_Q+2L\beta(\theta_2R+\Delta h_0)]-\varphi_3M_f+M_k+M_g=\varphi_1M_Q+\varphi_2(\theta_2R+\Delta h_0)-\varphi_3M_f+M_k+M_g$$

in the above formula:

$\varphi_1$ is an overturning moment coefficient;

$M_Q$ is the overturning moment of the ship reception chamber caused by the water surface fluctuation and the eccentric loads of the ship reception chamber, and its unit is kN·m;

$\varphi_2$ is a manufacturing error coefficient;

$\theta_2R+\Delta h_0$ is the manufacturing errors of the mechanical synchronizing system;

$\varphi_1M_Q$ represents influence on the torque of the synchronizing shafts due to the overturning moment $M_Q$ of the ship reception chamber caused by the water surface fluctuation and the eccentric loads of the ship reception chamber;

$\varphi_2(\theta_2R+\Delta h_0)$represents influence on the torque of the synchronizing shafts due to the manufacturing errors $\theta_2R+\Delta h_0$of the mechanical synchronizing system after water is loaded to the ship reception chamber;

$\varphi_1M_Q+\varphi_2(\theta_2R+\Delta h_0)$ represents influence on the torque of the synchronizing shafts due to the water body in the ship reception chamber;

$-\varphi_3M_f$ reflects a resistance of the system friction force to the torque of the synchronizing shafts;

$M_k$ reflects internal an internal torque change of the synchronizing shafts generated by the mounting errors when the synchronizing shafts rotate;

$M_g$ reflects an initial torque generated to the synchronizing due to unbalance stress of adjacent drums and wire ropes when the ship reception chamber is initially leveled;

when the ship reception chamber without water lifts up and down, influence of both $\varphi_1M_Q+\varphi_2(\theta_2R+\Delta h_0)$is ignored, so, when the ship reception chamber without water lifts up and down, the torque of the synchronizing shafts can be expressed as follows:

$$T_N=-\varphi_3M_f+M_k+M_g$$

III. clearance and manufacturing error control conditions;

the manufacturing errors of the mechanical synchronizing system are controlled according to the following conditions:

$$(\theta_2R+\Delta h_0) \le \frac{\Delta h_{max}+\gamma_3M_f-\gamma_2(M_b+M_p)}{\gamma_1} \quad (6)$$

$$(\theta_2R+\Delta h_0) \le \frac{(M_{max}-M_k-M_g)+\varphi_3M_f-\varphi_1M_Q}{2L\beta\varphi_1} \quad (7)$$

in the formulas:

$\Delta h_{max}$ is the allowable maximum tilt of the ship reception chamber and its unit is m; and $M_{max}$ is an allowable maximum torque of the mechanical synchronizing system and its unit is kN·m.

9. The method of claim 7, wherein the stabilizing and equalizing hydraulic driving system comprising: vertical shafts; a water level equalizing gallery; a water delivery main pipe; a plurality of branch water pipes each comprising angle pipes and bifurcated pipes; first resistance equalizing members; and second resistance equalizing members;

in the water delivery main pipe and the plurality of branch water pipes of the stabilizing and equalizing hydraulic driving system:

a length and section dimension of a pipe segment from a water delivery main pipe entrance to a corresponding vertical shaft is equal to a total length and total section dimension of a corresponding branch water pipe;

for the branch water pipes, the first resistance equalizing members arranged at the corners of the angle pipes or/and the second resistance equalizing members arranged at the bifurcated pipes fulfill the following:

(1) when maximum flow rate of the branch water pipes is smaller than 2 m/s, the first resistance equalizing members reduce a bias water flow condition at the corners of the branch water pipes;

(2) when the maximum flow rate of the branch water pipes is smaller than 4 m/s, the second resistance equalizing members equalize the flow rate at the bifurcated pipes of the branch water pipes;

(3) when the maximum flow rate of the branch water pipes is smaller than 6 m/s, the first resistance equalizing members and the second resistance equalizing members are designed simultaneously;

a minimum cross section area of the water level equalizing gallery is calculated by the following formula:

$$\omega = K\frac{2C\sqrt{H}}{\mu T\sqrt{2g}} \tag{8}$$

in the formula:

ω is an area of the water level equalizing gallery and its unit is $m^2$;

C is an area of adjacent vertical shafts and its unit is $m^2$;

H is an allowable maximum water level difference of adjacent vertical shafts, and its unit is m;

μ is a flow rate coefficient of the water level equalizing gallery;

T is maximum water level difference allowable lasting time and its unit is s;

K is a safety coefficient of 1.5-2.0; and g is gravitational acceleration and its unit is $m/s^{-2}$.

10. The method of claim 7, wherein the self-feedback stabilizing system comprising: guide rails; and a guide wheel mechanism comprising guide wheels, flexible members, and limiting stoppers; in the self-feedback stabilizing system:

(1) an overturning moment after the ship reception chamber tilts is calculated by the following formula:

$$N_{qf}=(1/2\times 2\Delta\times L_c)\times B_c\times(2/3L_c-1/2L_c) \text{ unit: t·m}$$

an anti-overturning moment of the guide wheel mechanism is calculated by the following formula:

$$N_{kf}=4\times(2\Delta/L)\times L^*\times K^*\times L^* \text{ unit: t·m}$$

in the foregoing two formulas:

$L_c$ is the length of the ship reception chamber and its unit is m;

$B_c$ is the width of the ship reception chamber and its unit is m;

L* is an interval of guide wheels on the same side of the guide wheel mechanism, and its unit is m;

K* is a rigidity of the flexible members in the guide wheel mechanism and its unit is t/m;

Δ is the tilt of the ship reception chamber and its unit is m; by taking the transverse center line of the ship reception chamber as reference, one end is reduced by "Δ", one end is increased by "Δ", and the height difference of these two ends is "2Δ"; and L is the length of the ship reception chamber;

(2) the rigidity of the flexible members in the guide wheel mechanism fulfills the following formula:

$$K^*=N_{kf}/N_{qf};$$

K*>1 represents that the guide wheel mechanism has an anti-overturning capability;

K*<1 represents that the guide wheel mechanism does not have an anti-overturning capability; and K*=1 represents that the guide wheel mechanism provides an unstable anti-overturning capability;

(3) a clearance of the limiting stoppers in the guide wheel mechanism fulfill the following:

a maximum unevenness of one guide rail is δ, in operation, along with the rolling of the guide wheels, rotation displacement at a clearance of the guide wheels is:

$$\delta^*=(a^*/b^*)\times\delta;\text{and}$$

to prevent the guide wheels from jamming, the following condition is fulfilled:

$$\delta^*>\delta.$$

* * * * *